US010772423B2

(12) United States Patent
Lee et al.

(10) Patent No.: US 10,772,423 B2
(45) Date of Patent: Sep. 15, 2020

(54) STORAGE CONTAINER AND REFRIGERATOR HAVING THE SAME

(71) Applicant: SAMSUNG ELECTRONICS CO., LTD., Suwon-si, Gyeonggi-do (KR)

(72) Inventors: Jae Bok Lee, Seongnam-si (KR); Myoung Jin Jang, Hwaseong-si (KR); Sang Chul Ryu, Gwangju (KR); Kyoung-Sun Park, Hwaseong-si (KR); Sang Gyu Jung, Suwon-si (KR); In-Sung Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 20 days.

(21) Appl. No.: 15/799,210

(22) Filed: Oct. 31, 2017

(65) Prior Publication Data

US 2018/0116399 A1 May 3, 2018

(30) Foreign Application Priority Data

Oct. 31, 2016 (KR) ..... 10-2016-0143515

(51) Int. Cl.
*A47B 88/975* (2017.01)
*A47B 88/90* (2017.01)
(Continued)

(52) U.S. Cl.
CPC ..... *A47B 88/975* (2017.01); *A47B 88/90* (2017.01); *F25D 23/069* (2013.01);
(Continued)

(58) Field of Classification Search
CPC . A47B 88/975; A47B 88/90; A47B 2210/175; A47B 96/04; A47B 88/969;
(Continued)

(56) References Cited

U.S. PATENT DOCUMENTS 3,117,688 A * 1/1964 Walstad ..... B65D 25/06 217/31
7,296,433 B2 * 11/2007 Uihlein ..... F25D 23/021 312/402
(Continued)

FOREIGN PATENT DOCUMENTS

CN 101929785 12/2010
CN 102462224 5/2012
(Continued)

OTHER PUBLICATIONS

English translation of JP2015190728 (Year: 2015).*
(Continued)

*Primary Examiner* — Hiwot E Tefera
(74) *Attorney, Agent, or Firm* — Staas & Halsey LLP

(57) ABSTRACT

A storage container having a storage space, includes a partition member configured to divide the storage space of the storage container, the partition member having a first partition member movable in a first direction in the storage space, and a second partition member movable in a second direction in the storage space while crossing the first partition member, and a moving guide provided in an intersection between the first partition member and the second partition member and configured to guide a movement of the first partition member and a movement of the second partition member and to fix the first partition member and the second partition member so as not to move, the storage container may be configured to move a partition fixing portion disposed in the moving guide in a direction to contact the partition member according to the rotation of the upper portion of the moving guide.

12 Claims, 28 Drawing Sheets

(51) Int. Cl.
*F25D 23/06* (2006.01)
*F25D 25/00* (2006.01)
*F25D 25/02* (2006.01)

(52) U.S. Cl.
CPC ..... *F25D 25/005* (2013.01); *F25D 25/025* (2013.01); *A47B 2210/175* (2013.01); *F25D 2325/021* (2013.01)

(58) Field of Classification Search
CPC ... A47B 88/994; F25D 25/025; F25D 23/069; F25D 25/005; F25D 2325/021; F25D 25/022; F25D 23/065; F25D 11/00; F25D 23/12; F25D 23/04; F25D 25/00; E05B 65/46; B65D 25/02; B25D 25/04
USPC ..... 312/348.3, 402, 404, 350, 408, 410; 220/534, 544, 552; 211/184
See application file for complete search history.

(56) References Cited

U.S. PATENT DOCUMENTS

| | | | | |
|---|---|---|---|---|
| 9,207,011 | B2 * | 12/2015 | Song | F25D 25/025 |
| 2005/0061021 | A1 | 3/2005 | Uihlein et al. | |
| 2009/0133434 | A1 | 5/2009 | Uihlein et al. | |
| 2010/0072154 | A1 * | 3/2010 | Johnson | B60R 7/02 211/184 |
| 2010/0319391 | A1 * | 12/2010 | Lim | F25D 25/025 62/441 |
| 2013/0099651 | A1 * | 4/2013 | Hwang | F25D 25/025 312/404 |
| 2019/0357679 | A1 * | 11/2019 | Li | F25D 25/025 |

FOREIGN PATENT DOCUMENTS

| | | | |
|---|---|---|---|
| CN | 103075865 | 5/2013 | |
| CN | 204478657 | 7/2015 | |
| JP | 2015-190728 | 11/2015 | |
| KR | 10-2010-0137377 | 12/2010 | |
| KR | 10-2011-0028480 | 3/2011 | |
| KR | 10-2013-0044959 | 5/2013 | |
| KR | 101299065 B1 * | 8/2013 | F25D 25/025 |
| KR | 10-2014-0125493 | 10/2014 | |

OTHER PUBLICATIONS

Extended European Search Report dated Feb. 27, 2018, in corresponding European Patent Application No. 17199179.7, 8 pgs.
Chinese Office Action dated Sep. 4, 2019 in Chinese Patent Application No. 201711050470.9.
European Office Action dated Oct. 8, 2019 in European Patent Application No. 17199179.7.

* cited by examiner

STORAGE CONTAINER AND REFRIGERATOR HAVING THE SAME

CROSS-REFERENCE TO RELATED APPLICATION(S)

This application claims the benefit of Korean Patent Application No. 10-2016-0143515, filed on Oct. 31, 2016 in the Korean Intellectual Property Office, the disclosure of which is incorporated herein by reference.

BACKGROUND

1. Field

Embodiments of the present disclosure relate to a refrigerator having a storage container provided with a partition portion capable of dividing an internal storage space into an appropriate size and securing the appropriate size space.

2. Description of Related Art

In general, a refrigerator is an apparatus keeping foods at a low temperature by supplying low-temperature cold air to a storage compartment where the food is stored. The refrigerator has a freezing compartment maintaining the temperature below a freezing temperature and a refrigerating compartment maintaining the temperature slightly higher than the freezing temperature.

The storage capacity of the refrigerator tends to be large due to the diversification of life, and a storage container may be provided in the large-sized refrigerator wherein the storage container is configured to be inserted into or pulled out to allow vegetables and fruits to be stored therein.

The storage container is provided with a storage space for storing food therein. In recent years, a storage container in which the storage space is divided has been developed so that different kinds of food are organized without mixing.

In the case of dividing the storage space as described above, when the size of the divided storage space is fixed or arbitrarily adjusted, there are difficulties in easily fixing the adjusted storage space.

SUMMARY

Therefore, it is an aspect of the present disclosure to provide a storage container capable of fixing a partition member dividing a storage space, based on a rotation of a part of a moving guide contained in a partition portion dividing the storage space.

Additional aspects of the present disclosure will be set forth in part in the description which follows and, in part, will be obvious from the description, or may be learned by practice of the present disclosure.

In accordance with one aspect of the present disclosure, a storage container having a storage space includes a partition member configured to divide the storage space of the storage container, the partition member having a first partition member movable in a first direction in the storage space, and a second partition member movable in a second direction in the storage space so that the first partition member and the second partition member cross each other, a moving guide provided in an intersection between the first partition and the second partition and configured to guide a movement of the first partition member and a movement of the second partition member, the moving guide including an upper portion, and a lower portion to be coupled to the upper portion, the lower portion including a partition fixing portion movable when the upper portion is rotated with respect to the lower portion, the storage container may be configured to move a partition fixing portion disposed in the moving guide in a direction to contact the partition member according to the rotation of the upper portion of the moving guide.

The moving guide may include a first through hole through which the first partition is passed and a second through hole vertically spaced apart from the first through hole and through which the second partition is passed.

The lower portion of the moving guide may further include a middle portion coupled to the upper portion and a lower portion coupled to the middle portion, wherein the moving guide may form the first through hole and the second through hole by the coupling between the middle portion and the lower portion.

The partition fixing portion may further include a stopper, wherein the stopper may be in contact with the first partition and the second partition to fix the movement of the first partition and the second partition.

A surface of the stopper may be formed of a material having the high frictional force.

The stopper may be formed of a silicon or a rubber material.

The upper portion of the moving guide is provided with an inclined surface inside thereof, and the partition fixing portion comprises a follower in contact with the inclined surface, wherein when the upper portion is rotated, the partition fixing portion may be moved based on the difference in the height of the inclined surface.

When the partition fixing portion is furthest away from the upper portion according to a rotation of the upper portion, the stopper may come into contact with the first partition member and the second partition member.

The inclined surface of the upper portion may further include a locking protrusion, wherein when the locking protrusion comes into contact with the follower, which moves with the contact with the inclined surface, and then the contact between the locking protrusion and the follower is released according to a rotation of the upper portion, the vibration or the noise may be generated by the contact between the inclined surface and the follower.

When the upper portion is rotated in the first direction, the stopper comes into contact with the first partition member and the second partition member and when the upper portion is rotated in the second direction, the stopper may be away from the first partition member and the second partition member.

In accordance with another aspect of the present disclosure, a refrigerator includes a body having a storage compartment, a door configured to open or close the storage compartment, a storage container configured to be inserted into or pulled out from the storage compartment and having a storage space, a partition member configured to divide the storage space of the storage container, the partition member having a first partition member movable in a first direction in the storage space, and a second partition member movable in a second direction in the storage space so that the first partition member, and the second partition member cross each other, a moving guide provided in an intersection between the first partition member and the second partition member and configured to guide a movement of the first partition member and the second partition member, the moving guide including an upper portion, and a lower portion to be coupled to the upper portion, the lower portion including a partition fixing portion movable when the upper portion is rotated with respect to the lower portion, wherein when the upper portion of the moving guide is rotated, the partition fixing portion is moved to regulate at least one of the movement of the first partition member in the first direction and the movement of the second partition member in the second direction.

In accordance with still another aspect of the present disclosure, a moving guide to manipulate spacing of a storage of a refrigerator includes an upper portion having an inclined surface in the inside thereof, and a lower portion to be coupled to the upper portion, the lower portion including a partition fixing portion movable when the upper portion is rotated with respect to the lower portion and having a follower in contact with the inclined surface, wherein when the upper portion is rotated, the partition fixing portion having the follower is moved according to the movement of the inclined surface.

In accordance with still another aspect of the present disclosure, a storage container provided with a storage space includes a partition member configured to divide the storage space of the storage container by having a first partition member movable in a first direction in the storage space, and a second partition member movable in a second direction in the storage space while crossing the first partition member, and a moving guide provided in the intersection between the first partition member and the second partition member and configured to guide the movement of the first partition member and the second partition member and to fix the first partition member and the second partition member so as not to move, wherein the storage container may be configured to release contact with the first partition fixing portion and the second partition fixing portion by moving the first partition fixing portion and the second partition fixing portion disposed inside the moving guide in a second direction perpendicular to the first direction based on movement of the lever of the moving guide in a first direction.

The moving guide may be provided with a first through hole through which the first partition member is passed and a second through hole vertically spaced apart from the first through hole and through which the second partition member is passed.

The moving guide may further include an upper portion into which the lever is inserted, a middle portion and a lower portion coupled to the middle portion, wherein the moving guide may form the first through hole and the second through hole by the coupling between the middle portion and the lower portion.

The partition fixing portion may further include a stopper, wherein the stopper may be in contact with the first partition member and the second partition member to fix the movement of the first partition member and the second partition member.

A surface of the stopper may be formed of a material having the high frictional force.

The storage container may be configured to move the first partition fixing portion and the second partition fixing portion in a direction away from the partition member based on the movement of the lever in the direction towards the moving guide.

In accordance with still another aspect of the present disclosure, a storage container provided with a storage space includes a partition member configured to divide the storage space of the storage container by having a first partition member movable in a first direction in the storage space, and a second partition member movable in a second direction in the storage space while crossing the first partition member, and a moving guide provided in the intersection between the first partition member and the second partition member and configured to guide the movement of the first partition member and the second partition member and to fix the first partition member and the second partition member so as not to move, wherein the moving guide may be configured to release contact with the first partition fixing portion and the second partition fixing portion by moving the first partition fixing portion and the second partition fixing portion disposed inside the moving guide in a second direction perpendicular to the first direction based on movement of the lever of the moving guide in a first direction.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
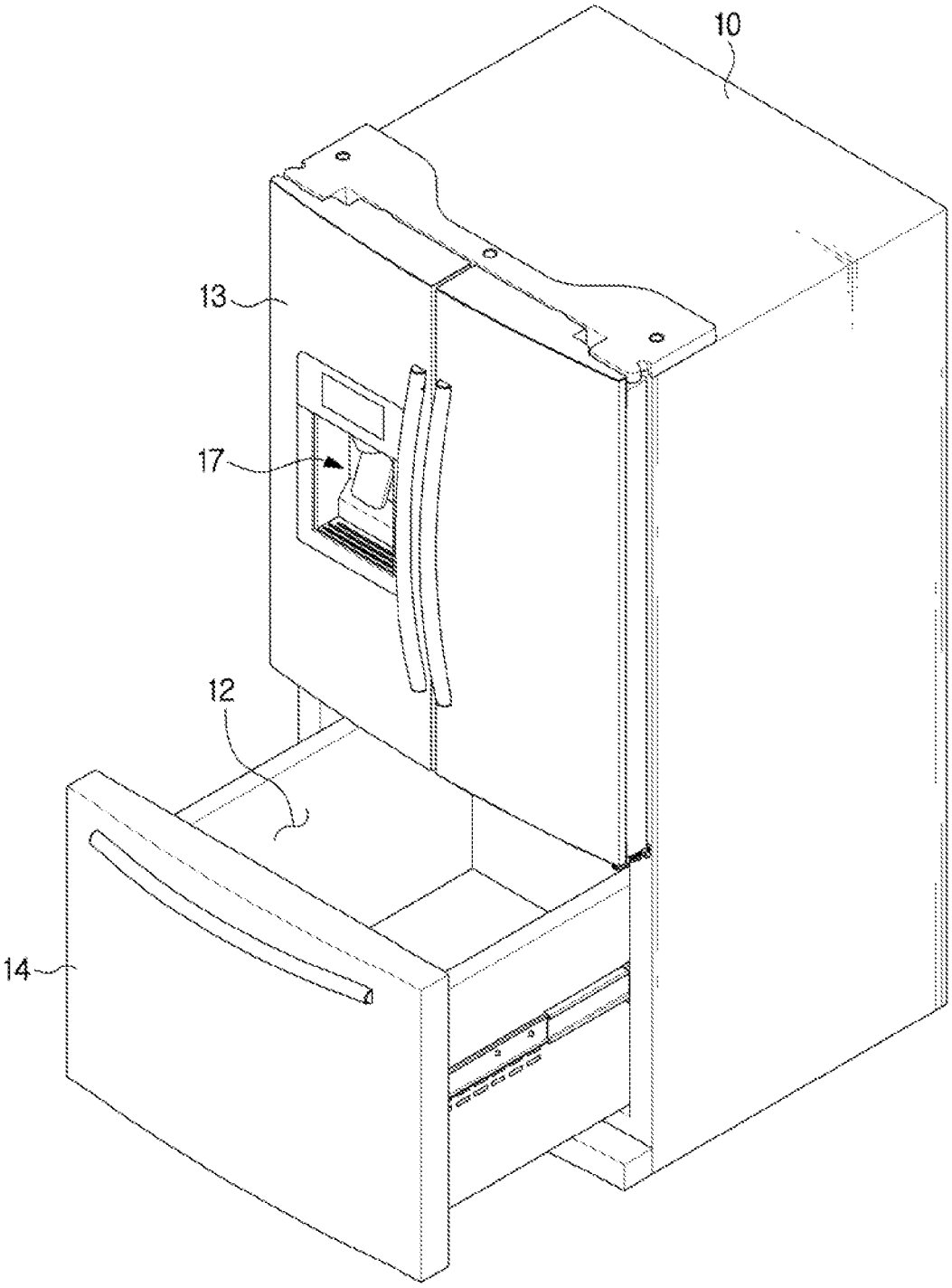
FIG. 1 is a perspective view schematically illustrating an appearance of a refrigerator in accordance with an embodiment of the present disclosure.

Embodiments described in the present disclosure and configurations shown in the drawings are merely examples of the embodiments of the present disclosure, and may be modified in various different ways at the time of filing of the present application to replace the embodiments and drawings of the present disclosure.

In addition, the same reference numerals or signs shown in the drawings of the present disclosure indicate elements or components performing substantially the same function.

Also, the terms used herein are used to describe the embodiments and are not intended to limit and/or restrict the present disclosure. The singular forms "a," "an" and "the" are intended to include the plural forms as well, unless the context clearly indicates otherwise. In this present disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the present disclosure, a first element may be termed as a second element, and a second element may be termed as a first element. The term of "and/or" includes a plurality of combinations of relevant items or any one item among a plurality of relevant items.

In the following detailed description, the terms of "front end", "rear end", "upper portion", "lower portion", "upper end", "lower end" and the like may be defined by the drawings, but the shape and the location of the component is not limited by the term.

The present disclosure will be described more fully hereinafter with reference to the accompanying drawings.

Figure 2:
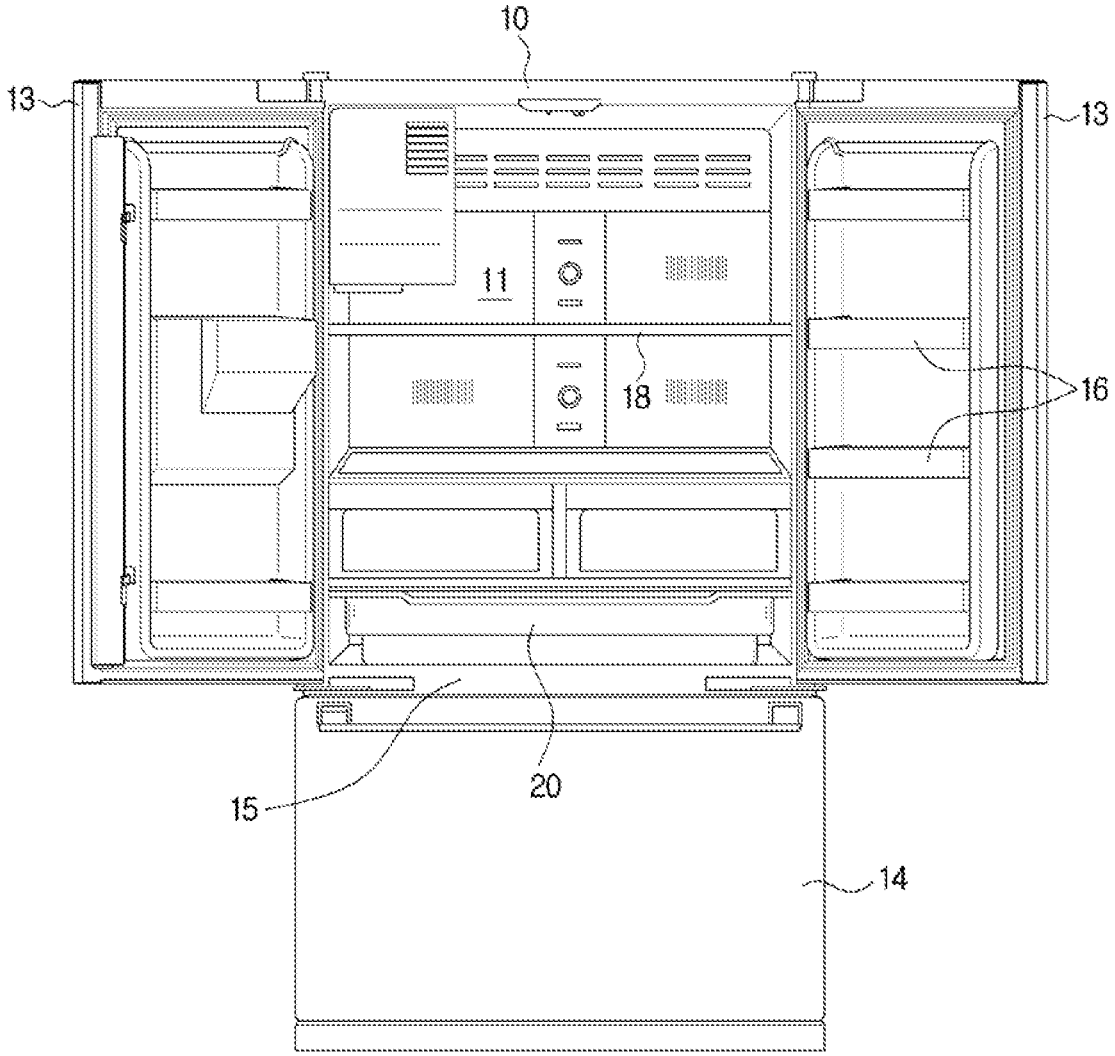
FIG. 2 is a perspective view illustrating an inside of a refrigerating compartment of the refrigerator in accordance with an embodiment of the present disclosure.

FIG. 1 is a perspective view schematically illustrating an appearance of a refrigerator in accordance with an embodiment of the present disclosure, and FIG. 2 is a perspective view illustrating an inside of a refrigerating compartment of the refrigerator in accordance with an embodiment of the present disclosure.

Referring to FIGS. 1 and 2, a refrigerator according to various embodiments may include a body 10 in which a storage compartment 11 and 12 is formed and a door 13 and 14 closing and opening the front surface of the body 10.

The storage compartment 11 and 12 may be provided with an upper refrigerating compartment 11 and a lower freezing compartment 12, which are divided by a horizontal partition 15 configured to divide the body 10 into the upper portion and the lower portion. The door 13 and 14 may include a refrigerating compartment door 13 opening and closing the refrigerating compartment 11 and a freezing compartment door 14 opening and closing the freezing compartment 12.

A plurality of door guards 16 storing beverages and small-volume foods may be provided inside the refrigerating compartment door 13. The refrigerator compartment door 13 may be provided with a dispenser 17 allowing a user to take out water or ice in the outside.

A plurality of shelves 18 on which foods are placed may be provided in the upper portion of the refrigerating compartment 11 and a plurality of storage containers 20 having storage space for storing vegetables and fruits may be provided in the lower portion of refrigerator compartment 11.

According to various embodiments, the storage container 20 is provided to be inserted into or pulled out from the storage compartment 11 and 12, but is not limited thereto. For example, the storage container 20 may be formed with a drawer-type storage container 20 whose front surface is made of a door and configured to be pulled out from the refrigerator.

Figure 3:
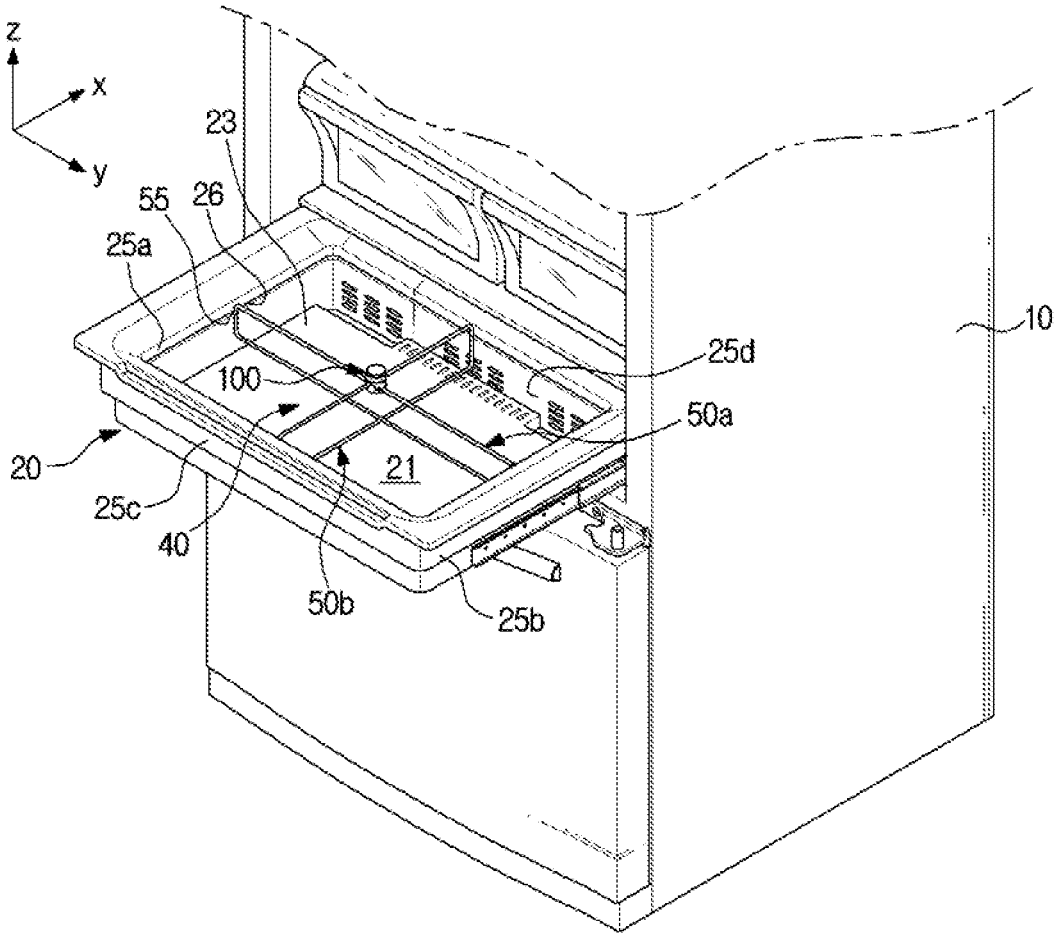
FIG. 3 is a perspective view illustrating a state in which a storage container is pulled out from a refrigerator in accordance with various embodiments.
Figure 4:
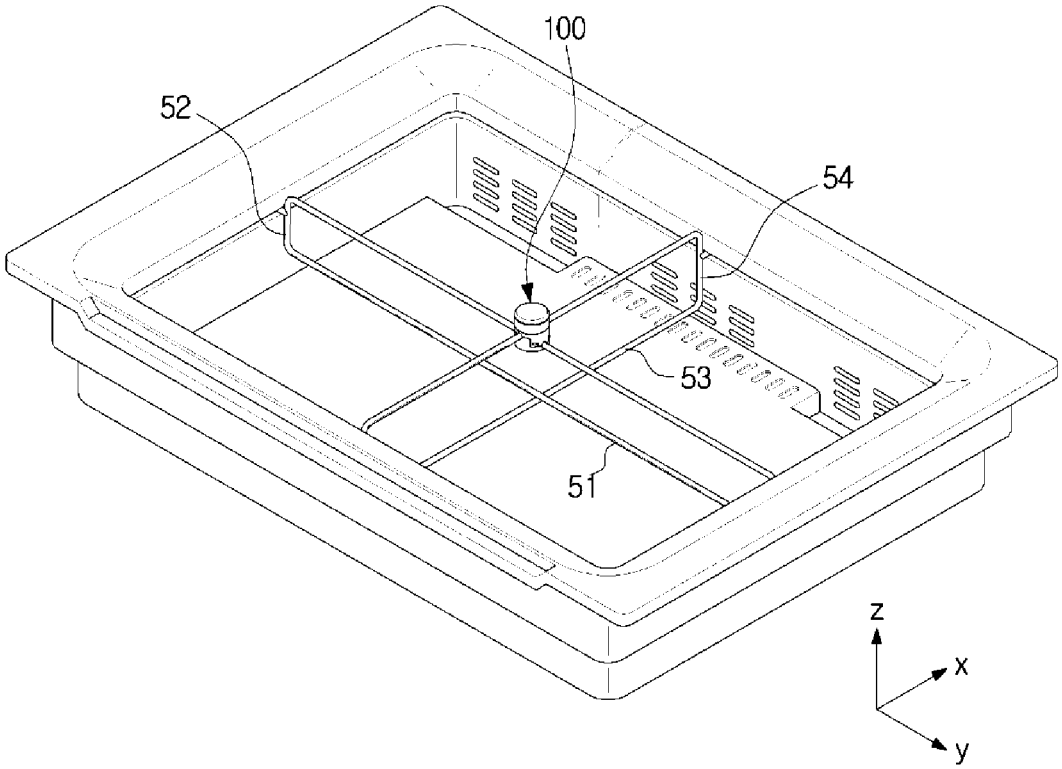
FIG. 4 is a perspective view illustrating the storage container of the refrigerator in accordance with various embodiments.

FIG. 3 is a perspective view illustrating a state in which a storage container is pulled out from a refrigerator in accordance with various embodiments. FIG. 4 is a perspective view illustrating the storage container of the refrigerator in accordance with various embodiments.

Referring to FIGS. 3 and 4, the storage container 20 may be formed in a hexahedron shape having an opened upper surface, wherein the storage container 20 is provided with a bottom surface 23 and a vertical wall 25 extended from an edge portion of the bottom surface 23 toward an upper side (+Z axis) to form a storage space 21 in which the foods are stored, The vertical wall 25 may be formed with both side walls and 25*b*, which are connected to the upper side (+Z axis) from both side edges of the bottom surface 23 and parallel with the X axis, and a front wall 25*c* and a rear wall 25*d* connected to the upper side from an edge portion of the front and rear side of the bottom surface 23 and parallel with the Y axis.

According to various embodiments, the vertical wall 25 may be provided with a guide slot 26 cut elongated in the left and right direction. The guide slot 26 may form a path to which a partition member 50, which will be described later, is inserted and moved.

In the storage space 21, a partition portion 40 partitioning the storage space 21 into a plurality of areas may be provided. The partition portion 40 may include the partition member 50 dividing the storage space 21 into the front and rear area or right and left area so as to partition the storage space 21 into two or more independent spaces.

According to various embodiments, the partition member 50 may include a first partition member 50*a* partitioning the storage space 21 in the front-rear direction and a second partition member 50*a* partitioning the storage space 21 in the left-right direction by crossing the first partition member 50*a*.

The partition member 50 may be formed in a closed rectangular line having a pair of long sides and a pair of short sides, particularly the partition member 50 is provided with a pair of horizontal rods 51 and 53 which are vertically spaced apart from each other to face to each other, and a pair of vertical rods 52 and 54 connecting each end portion of the horizontal rods 51 and 53. The horizontal rods 51 and 53 and the vertical rods 52 and 54 may be formed by bending a wire or a pipe having a sufficient rigidity, but is not limited thereto.

The length of the horizontal rod 51 of the first partition member 50*a* may be set to be slightly smaller than the distance between the opposite side walls 25*a* and 25*b* of the storage container 20. The length of the horizontal rod 53 of the second partition member 50*a* may be provided to be slightly smaller than the distance between the front wall 25*c* and the rear wall 25*d* of the storage container 20.

The vertical rods 52 and 54 may be formed to have a length similar to the height of the storage space 21. A coupling protrusion 55 fitted in the guide slot 26 may be provided in at least one of the vertical rods 52 and 54, respectively.

A moving guide 100 guiding the first partition member 50*a* in the front and rear direction (the X axis direction) and guiding the second partition member 50*b* in the left and right direction (the Y axis direction) may be provided in a position in which the first partition member 50*a* and the second partition member 50*b* are across.

According to various embodiments, the moving guide 100 may be positioned at the intersection of the first partition member 50*a* and the second partition member 50*a* to guide the movement of the first partition member 50*a* and the second partition member 50*a*, while fixing or securing the first partition member 50*a* and the second partition member 50*a* so as not to move.

The first partition member 50*a* and the second partition member 50*a* may be moved simultaneously or sequentially when a force is applied in a direction to move at the intersection. Therefore, a user can move the first partition member 50*a* and the second partition member 50*a* by holding and moving the moving guide 100 provided at the intersection of the first partition member 50*a* and the second partition member 50*a*.

According to various embodiments, while allowing the first partition member 50*a* and the second partition member 50*a* to move easily, the moving guide 100 may partition the storage space 21 into a space with the appropriate size for the volume of the food to be stored and then fix the first partition member 50*a* and the second partition member 50*a*. When fixing the first partition member 50*a* and the second partition member 50*a* to a predetermined position by using the moving guide 100, the first partition member 50*a* and the second partition member 50*a* may be prevented from moving in the front and rear direction and the left and right direction.

Figure 5:
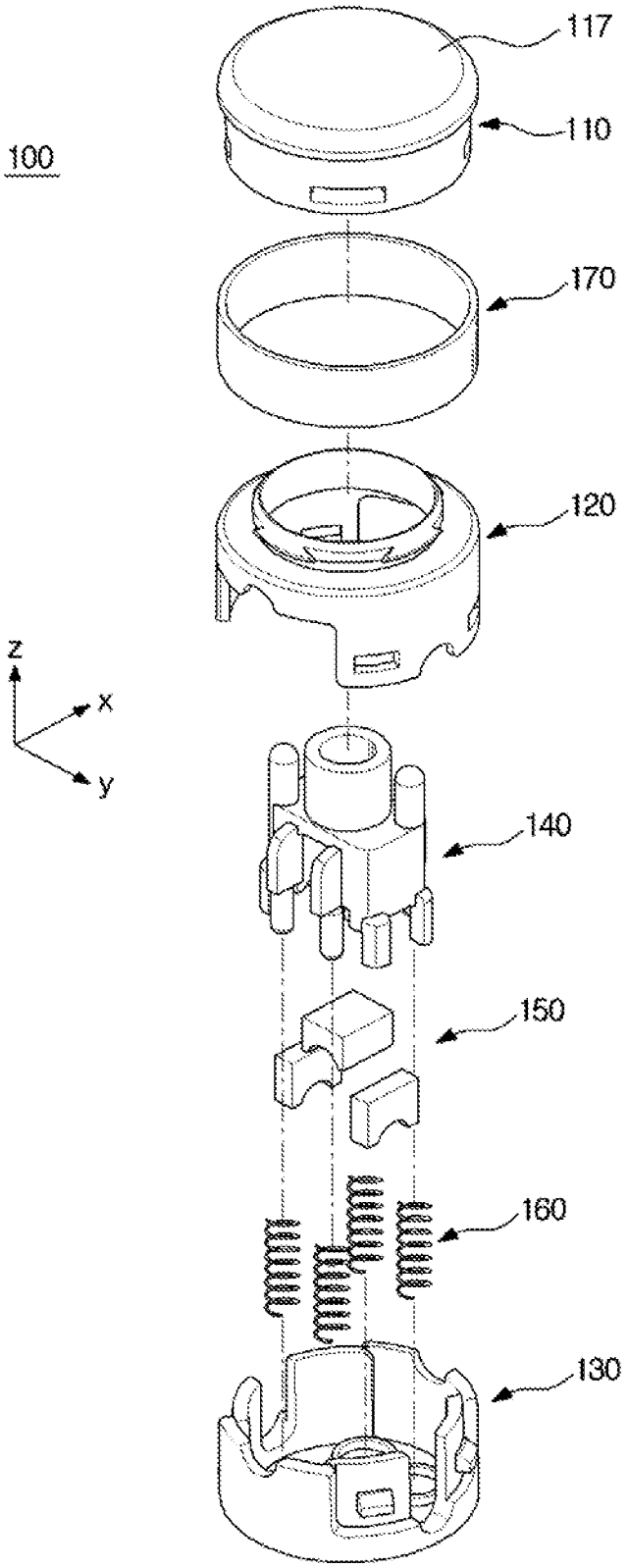
FIG. 5 is an exploded-perspective view illustrating a moving guide in accordance with various embodiments.
Figure 6:
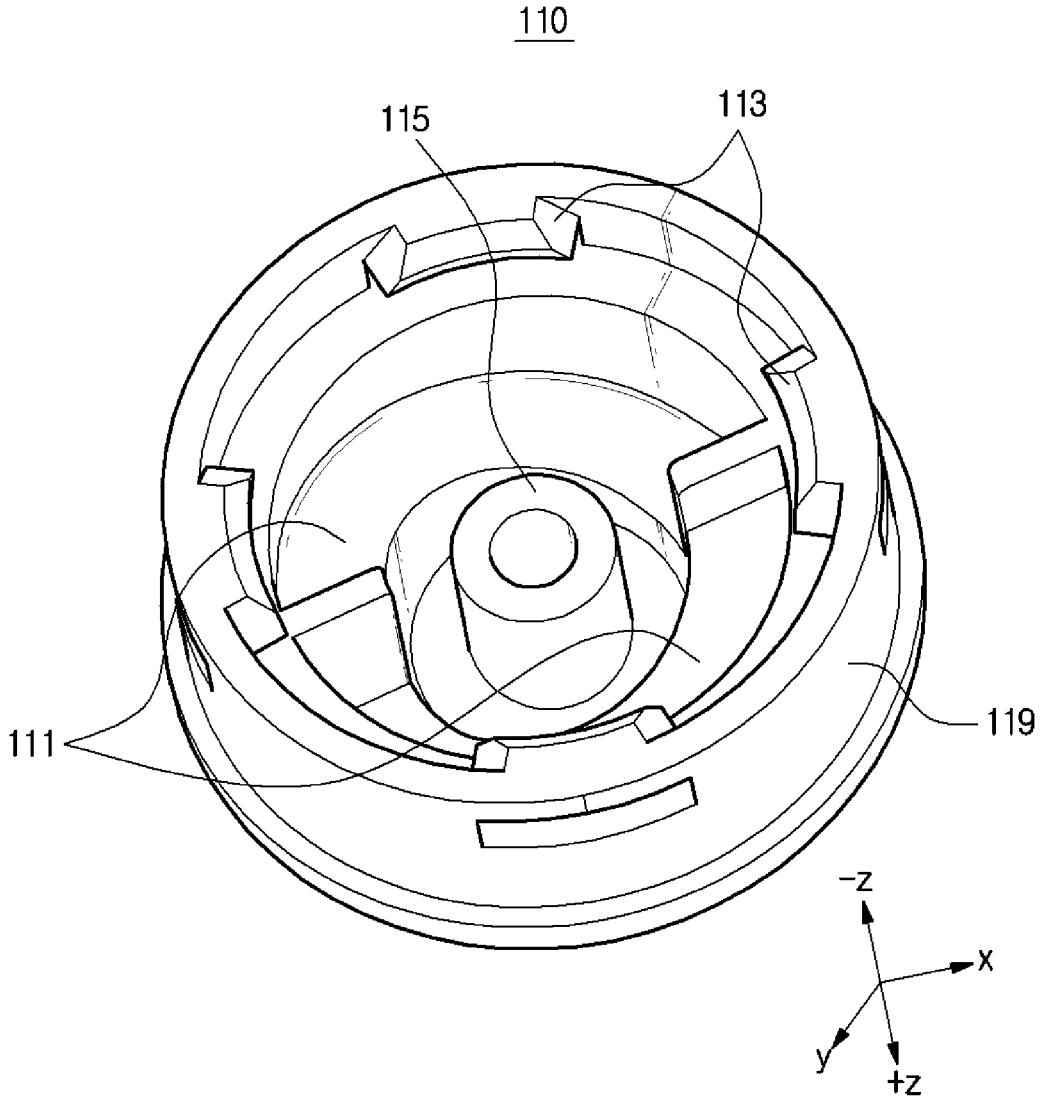
FIG. 6 is a perspective view illustrating an upper portion of the moving guide in accordance with various embodiments.
Figure 7:
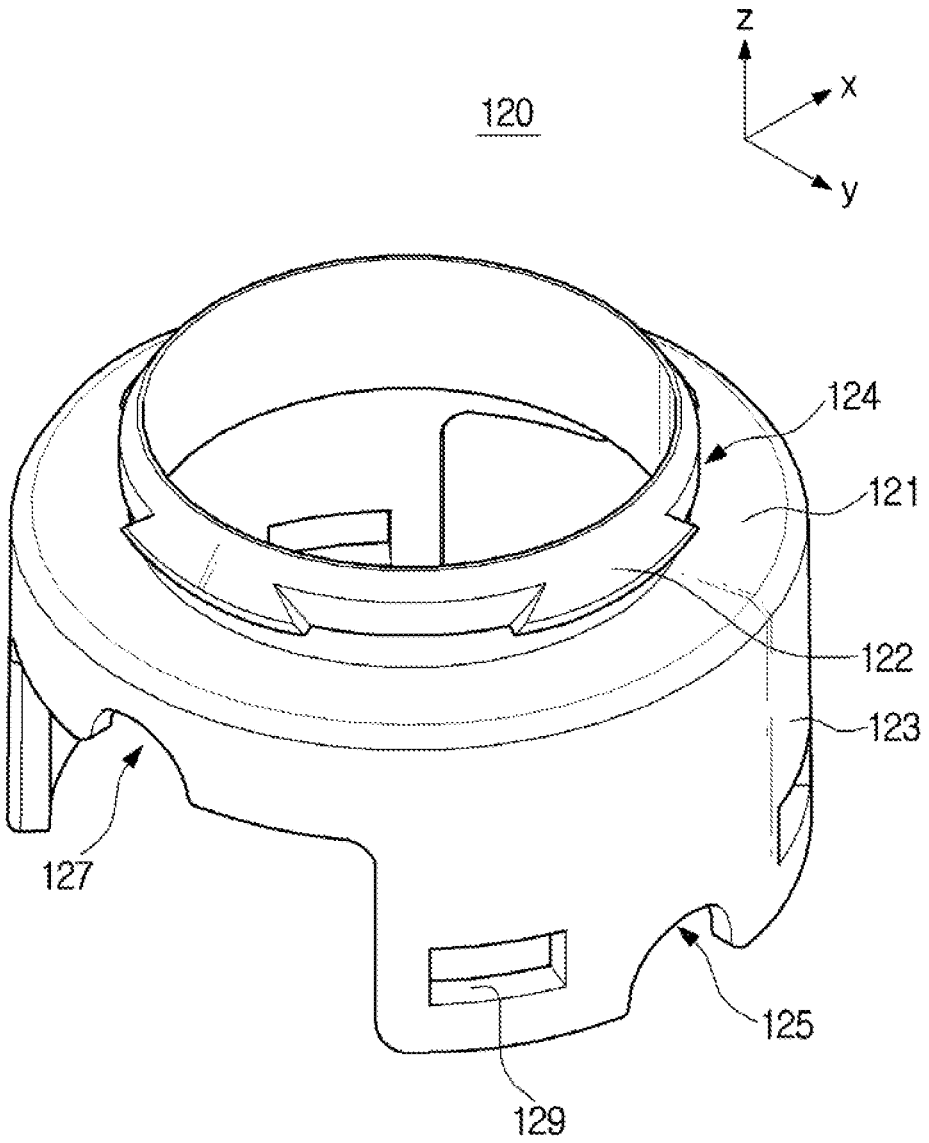
FIG. 7 is a perspective view illustrating a middle portion of the moving guide in accordance with various embodiments.
Figure 8:
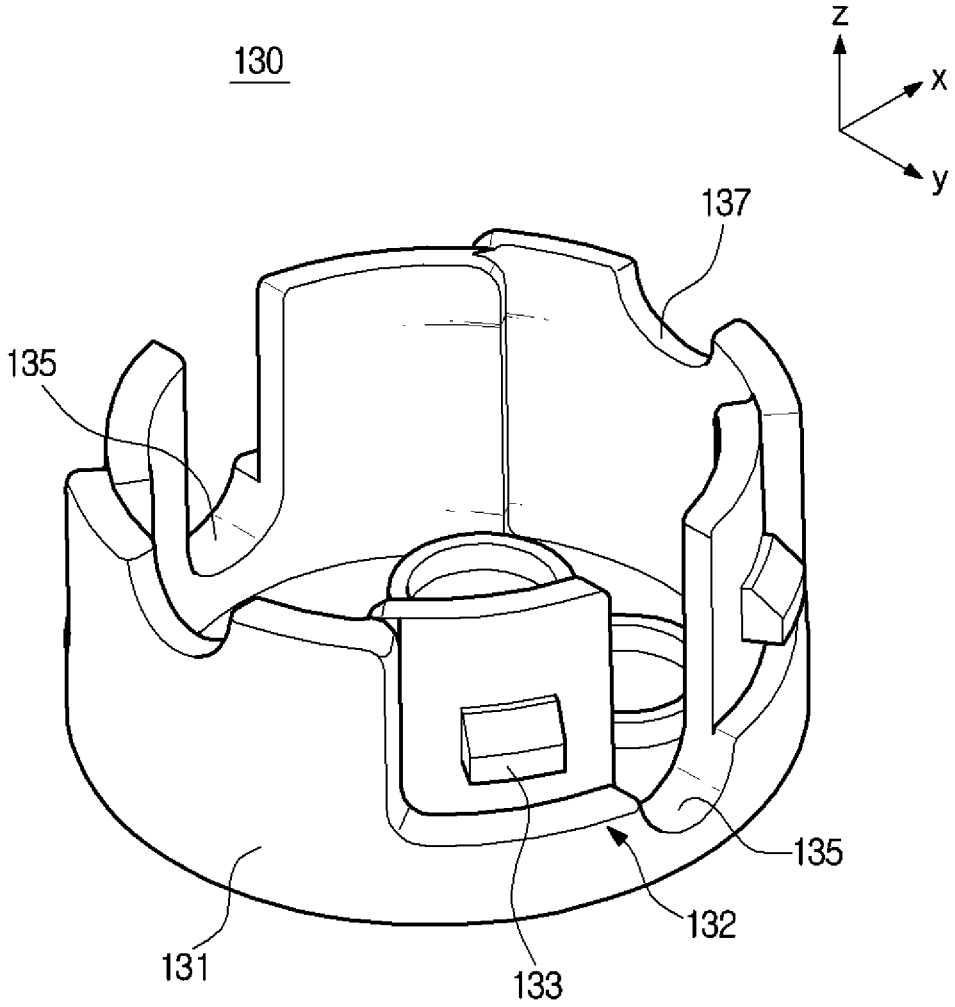
FIG. 8 is a perspective view illustrating a lower portion of the moving guide in accordance with various embodiments.
Figure 9:
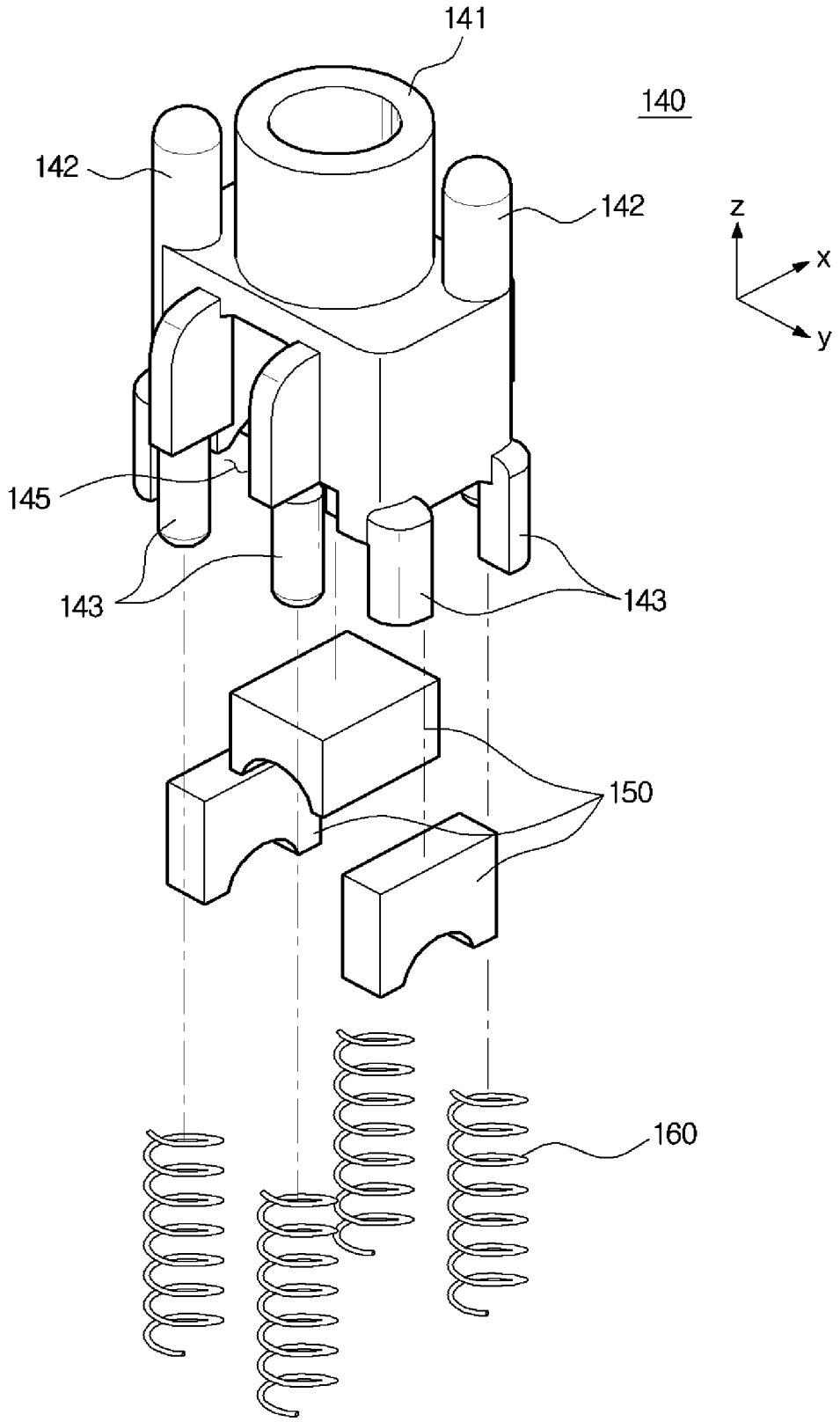
FIG. 9 is a perspective view illustrating a partition fixing portion provided inside the moving guide.

FIG. 5 is an exploded-perspective view illustrating a moving guide 100 in accordance with various embodiments. FIG. 6 is a perspective view illustrating an upper portion of the moving guide 100 in accordance with various embodiments. FIG. 7 is a perspective view illustrating a middle portion of the moving guide 100 in accordance with various embodiments. FIG. 8 is a perspective view illustrating a lower portion of the moving guide 100 in accordance with various embodiments. FIG. 9 is a perspective view illustrating a partition fixing portion 140 provided inside the moving guide 100. Hereinafter a configuration of the moving guide 100 will be described with reference to FIGS. 5 to 9.

Referring to FIG. 5, according to various embodiments the moving guide 100 may include an upper portion 110 rotated in a first and a second direction, a middle portion 120 coupled to the upper portion 110 to guide the rotation by being adjacent to the upper portion 110, a lower portion 130 forming a through hole in which the first partition member 50*a* and the second partition member 50*b* are passed through by being coupled to the lower portion 130, and an anti-slip portion 170 surrounding at least one portion of an outer surface of the upper portion 110.

The moving guide 100 may further include the partition fixing portion 140, which is provided inside of the upper portion 110, the middle portion 120 and the lower portion 130, and a stopper 150 coupled to the partition fixing portion 140. The partition fixing portion 140 to which the upper portion 110, the middle portion 120, the lower portion 130 and the stopper 150 are coupled may be coupled along the Z axis. The upper portion 110 may rotate in the first direction and the second direction in a state in which the respective components of the moving guide 100 are coupled to each other, and the partition fixing portion may be rotated in the vertical direction along the Z axis direction, according to the rotation of the upper portion 110.

The anti-slip portion 170 may be a portion preventing the slip when the user grasps the upper portion 110 and rotates the upper portion 110 in the first direction or the second direction or moves the upper portion 110 in the vertical direction. Therefore, the anti-slip portion 170 may be formed of a material having the high contact force, such as silicon or rubber material, but is not limited thereto.

FIG. 6 is a perspective view of the upper portion 110 rotatable in the first direction and second direction in the moving guide 100 in accordance with various embodiments.

Referring to FIG. 6, the upper portion 110 of the moving guide 100 may include a central axis 115 fastened to the partition fixing portion 140 at a central portion thereof. The central axis 115 may be inserted into a circular groove 141 provided in the upper portion of the partition fixing portion 140. The upper portion 110 of the moving guide 100 may be rotated in the first and second direction with respect to the Z axis while the central axis 115 at the upper portion 110 of the moving guide 100 is inserted into the circular groove 141 of the partition fixing portion 140. In this case, the first direction and the second direction may be clockwise or counterclockwise, but is not limited thereto. When the upper portion 110 of the moving guide 100 rotates, the partition fixing portion 140 may vertically move along the Z-axis direction.

According to various embodiments, the upper portion 110 may form an inclined surface 111 inside of an upper surface 117. The height of the inclined surface may increase along the direction of rotation of the upper portion 110. For example, the inclined surface 111 may be shaped such that the height of the inclined surface 111 increases gradually while drawing a circle toward the Y axis with respect to the X axis. At least one inclined surface 111 may be provided. The upper portion 110 may include a plurality of third protrusions 113 forming along a side surface 119 in a direction perpendicular to the Z axis. When the upper portion 110 is engaged with the middle portion 120, the third protrusion 113 may be disposed between a first protrusion 122 formed between a first coupling portion 124 formed in the middle portion 120 of the moving guide 100, and an upper surface 121 of the middle portion 120, and the upper surface 121 of the middle portion 120. In this case, although the upper portion 110 rotates, the upper portion 110 may be prevented from separating from the middle portion 120 by the third protrusion 113 and the first protrusion 122.

FIG. 7 is a perspective view of the middle portion 120 of the moving guide 100 in accordance with various embodiments.

Referring to FIG. 7, according to various embodiments the middle portion 120 of the moving guide 100 may include the first coupling portion 124 formed in the upper side thereof to be fastened to the upper portion 110 of the moving guide 100, and the first protrusion 122 formed in the direction perpendicular to the Z axis along the outer surface of the first coupling portion 124.

The middle portion 120 of the moving guide 100 may also be provided with semicircular spaces 125 and 127 through which the first partition member 50*a* and the second partition member 50*a* are passed, in the side surface 123. The semicircular spaces 125 and 127 may form a through hole through which the first partition member 50*a* and the second partition member 50*b* are passed, by being in contact with semicircular spaces 135 and 137, which will be described later, provided on the side surface 131 of the lower portion 130 of the moving guide 100. According to various embodiments, a through hole in which the first partition member 50*a* is located may be a first through hole, and a through hole in which the second partition member 50*a* is located may be a second through hole, but is not limited thereto.

On the side surface 123 of the middle portion 120 of the moving guide 100, a groove 129, which is fastened to a second protrusion 133 formed on the side surface 131 of the lower portion 130 of the moving guide 100, may be formed. By the coupling between the groove 129 and the second protrusion 133, the middle portion 120 and the lower portion 130 of the moving guide 100 may be coupled to each other.

FIG. 8 is a perspective view of the lower portion 130 of the moving guide 100 in accordance with various embodiments.

Referring to FIG. 8, according to various embodiments the lower portion 130 of the moving guide 100 may include a second coupling portion 132 formed on the side surface 131 to be fastened to the middle portion 120 of the moving guide 100, and the second protrusion 133 formed in the direction perpendicular to the Z axis along the outer surface of the second coupling portion 132.

The lower portion 130 of the moving guide 100 may be provided with the semicircular spaces 135 and 137 through which the first partition member 50*a* and the second partition member 50*a* are passed, in the side surface 131. The semicircular spaces 135 and 137 may form a through hole through which the first partition member 50*a* and the second partition member 50*b* are passed, by being in contact with semicircular spaces 125 and 127 provided on the side surface 123 of the middle portion 120 of the moving guide 100.

For example, when the semicircular space 125 provided in the side surface 123 of the middle portion 120 is combined with the semicircular space 135 provided in the side surface 131 of the lower portion 130, the first through hole may be formed. When the semicircular space 127 provided in the side surface 123 of the middle portion 120 is combined with the semicircular space 137 provided in the side surface 131 of the lower portion 130, the second through hole may be formed.

According to various embodiments, the first partition member 50*a* may be inserted into the first through-hole, and the second partition member 50*a* may be inserted into the second through hole, but is not limited thereto.

FIG. 9 is a perspective view illustrating the partition fixing portion 140 located in the moving guide 100 according to various embodiments.

Referring to FIG. 9, according to various embodiments, the partition fixing portion 140 may include a circular groove 141 to which the central axis 115 of the upper portion 110 of the moving guide 100 is inserted, a follower 142 in contact with the inclined surface 111 of the upper portion 110, a stopper locking groove 145 to which the stopper 150 is coupled, and a position fixing member 143 fixing the position of the partition fixing portion 140 to the direction of the upper portion 110 of the upper portion 110 in a state in which the moving guide 100 does not fix the partition member 50.

The central axis 115 of the upper portion 110 may be inserted into the empty space of the circular groove 141 of the partition fixing portion 140. The partition fixing portion 140 may be vertically moved in the Z axis direction in a state in which the central axis 115 at the upper portion 110 of the moving guide 100 is inserted into the circular groove 141 of the partition fixing portion 140. In this case, the upper portion 110 of the moving guide 100 may be rotated in the first direction or the second direction with respect to the Z axis.

According to various embodiments, the follower 142 may be in contact with the inclined surface 111 of the upper portion 110. Therefore, when the upper portion 110 rotates, the partition fixing portion 140 may vertically move in the Z axis according to the height of the inclined surface 111. For example, when the upper portion 110 rotates in the first direction, the height of the inclined surface 111 may increase, so that the partition fixing portion 140 may move downward along the Z axis. When the upper portion 110 rotates in the second direction, the height of the inclined surface 111 may decrease, so that the partition fixing portion 140 may move upward along the Z axis.

When the partition fixing portion 140 moves in the vertical direction, the partition fixing portion 140 may move along the central axis 115 of the upper portion 110 inserted into the circular groove 141 of the partition fixing portion 140. Therefore, the partition fixing portion 140 may move in the vertical direction while reducing the shaking in the left and right direction.

According to various embodiments, the stopper 150 may be coupled to the stopper locking groove 145 of the partition fixing portion 140. A contact surface of the stopper 150 may be made of a material having the high frictional force, e.g., a silicone material or a rubber material, but is not limited thereto. The shape of the surface in which the stopper 150 is in contact with the partition member 50 may be similar to the appearance of the partition member 50. For example, when the partition member 50 is in the shape of a cylinder, the surface in which the stopper 150 is in contact with the partition member 50 may also be rounded according to the appearance of the cylinder.

The stopper 150 may be not in contact or be in contact the partition member 50 based on the vertical movement of the partition fixing unit 140. For example, when the partition fixing portion 140 descends along the Z-axis, the stopper 150 may be in contact with the partition member 50. Therefore, the moving guide 100 may be fixed in position together with the partition member 50.

When the partition fixing portion 140 ascends along the Z axis, the contact between the stopper 150 and the partition member 50 may be released. Therefore, the position of the moving guide 100 may be changed. As a result, the size of all the storage spaces generated by the partition member 50 may vary.

According to various embodiments, the position fixing member 143 may further include an elastic member 160.

The elastic member 160 may be in the form of a spring that surrounds the position fixing member 143. The spring 160 may provide an elastic force on both sides along the Z-axis direction. Therefore, the spring 160 may always provide an elastic force to push the partition fixing portion 140 toward the upper portion 110 of the moving guide 100.

Accordingly, the follower 142 of the partition fixing portion 140 may easily maintain a state of being in contact with the inclined surface 111 of the upper portion 110. When the upper portion 110 rotates in the first direction or the second direction, the partition fixing portion 140 may be moved in the vertical direction along the Z-axis since the state in which the follower 142 is in contact with the inclined surface 111 of the upper portion 110 is maintained. According to various embodiments, the position fixing member 143 may implement the same effect as the above-described effect by using ribs.

Figure 10:
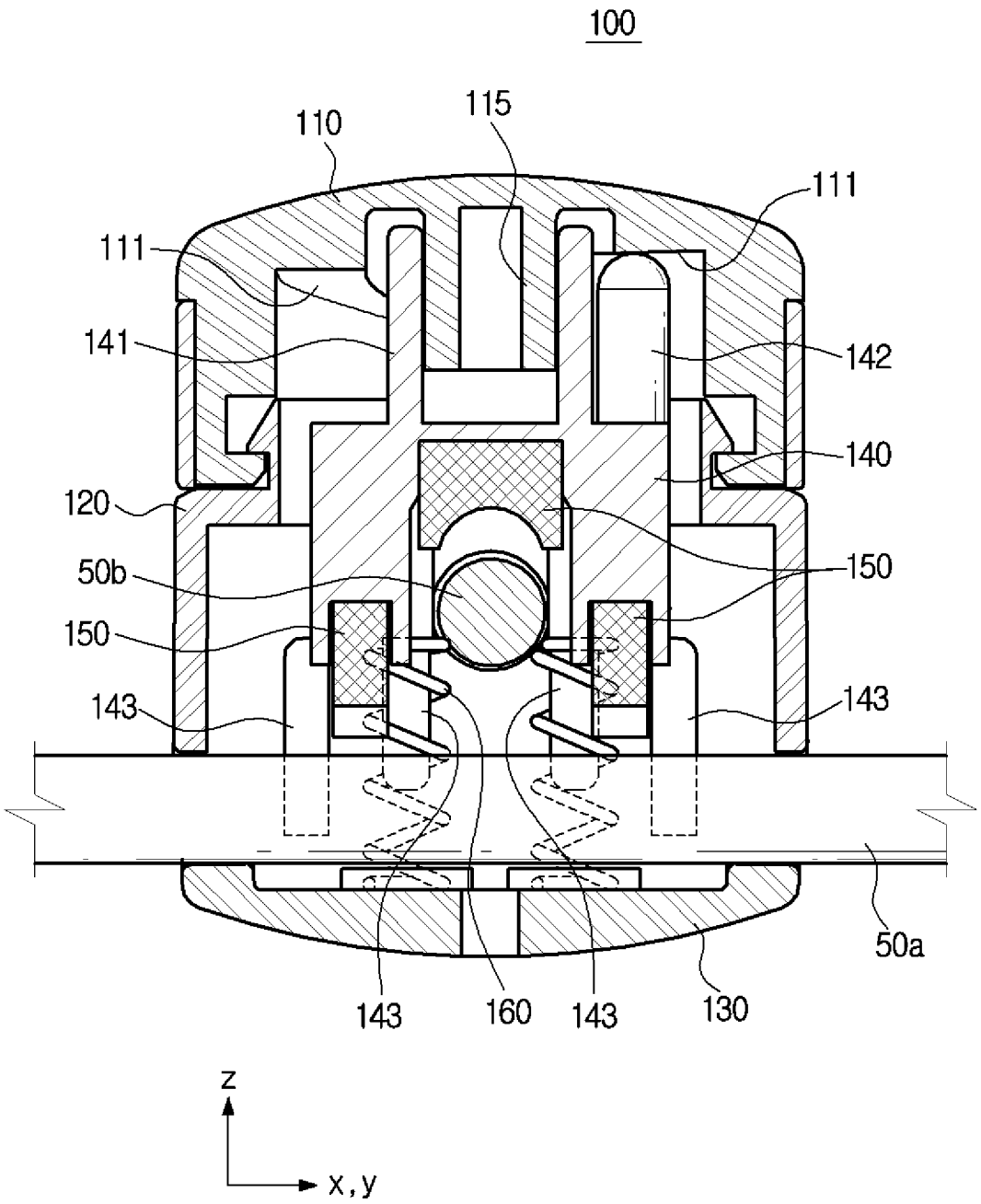
FIG. 10 is a cross-sectional view illustrating a case in which the moving guide does not fix the partition member according to various embodiments.

FIG. 10 is a cross-sectional view illustrating a case in which the moving guide 100 does not fix the partition member according to various embodiments.

Referring to FIG. 10, the components forming the moving guide 100 may be fastened. The central axis 115 of the upper portion 110 of the moving guide 100 may be inserted into the circular groove 141 of the partition fixing member 140. The partition fixing member 140 may be moved in the vertical direction along the Z-axis while the central axis 115 of the upper portion 110 is inserted thereto.

The upper portion 110 and the middle portion 120 of the moving guide 100 may be coupled to each other by using the third protrusion 113 provided in the side surface 119 of the upper portion 110 and the first coupling portion 124 provided in the upper portion of the middle portion 120. While the upper portion 110 is coupled to the middle portion 120 and the partition fixing portion 140, the upper portion 110 may be moved in the first direction or the second direction with respect to the Z-axis.

The middle portion 120 and the lower portion 130 of the moving guide 100 may be coupled to each other by using the groove 129 provided in the side surface 123 of the middle portion 120 and the second protrusion 133 provided in the side surface 131 of the lower portion 130. When the middle portion 120 is coupled to the lower portion 130 of the moving guide 100, at least two through holes in which the partition member 50 is placed may be formed. By using the through hole, the partition member 50 may be inserted into the moving guide 100.

The partition fixing member 140 of the moving guide 100 may be disposed in an inner space formed by fastening the upper portion 110, the middle portion 120, and the lower portion 130 of the moving guide 100. The elastic force of the elastic member 160 inserted into at least a part of the position fixing member 143 may push the partition fixing member 140 toward the upper portion 110 of the moving guide 100. Accordingly, the follower 142 of the partition fixing member 140 may be in contact with the inclined surface 111 located at the upper portion 110 of the moving guide 100.

Referring to FIG. 10, the follower 142 may be in contact with the highest point of the inclined surface 111. When the follower 142 comes into contact with the highest point of the inclined surface 111, the partition fixing member 140 may be placed at the uppermost position among the positions that can move along the Z axis. As the partition fixing member 140 is located at the uppermost position, the stopper 150 fastened to the partition fixing member 140 may be not in contact with the partition member 50.

Figure 11:
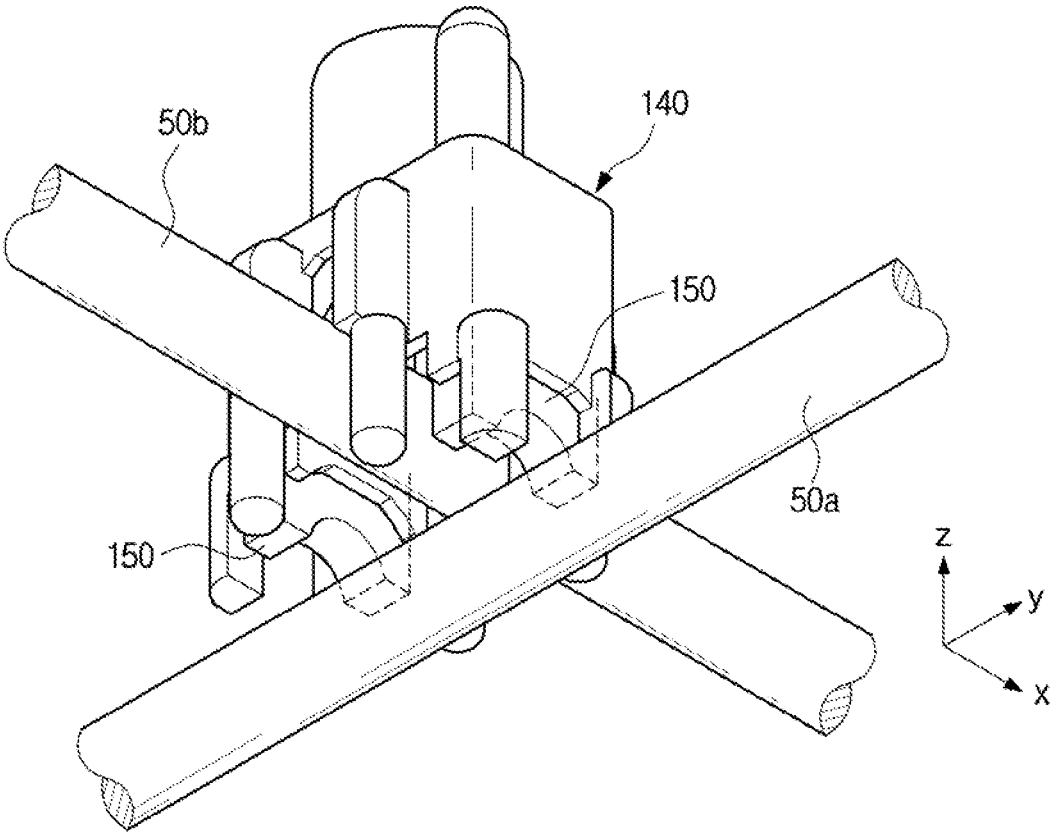
FIG. 11 is a perspective view illustrating a state in which the stopper is not in contact with the partition member in the moving guide according to various embodiments.

FIG. 11 is a perspective view illustrating a state in which the stopper is not in contact with the partition member in the moving guide 100 according to various embodiments.

Referring to FIG. 11, when the partition fixing member 140 is placed at the uppermost position as illustrated in FIG. 10, the stopper 150 fastened to the partition fixing member 140 may be not in contact with the first partition member 50*a* and/ or the second partition member 50*b*.

In this state, a user can freely adjust the sizes of the spaces generated by the first partition member 50*a* and the second partition member 50*a* in the storage space 21 by moving the moving guide 100. Accordingly, the user can make an appropriate size space in consideration of the size of various products to be stored in the storage space 21.

Figure 12:
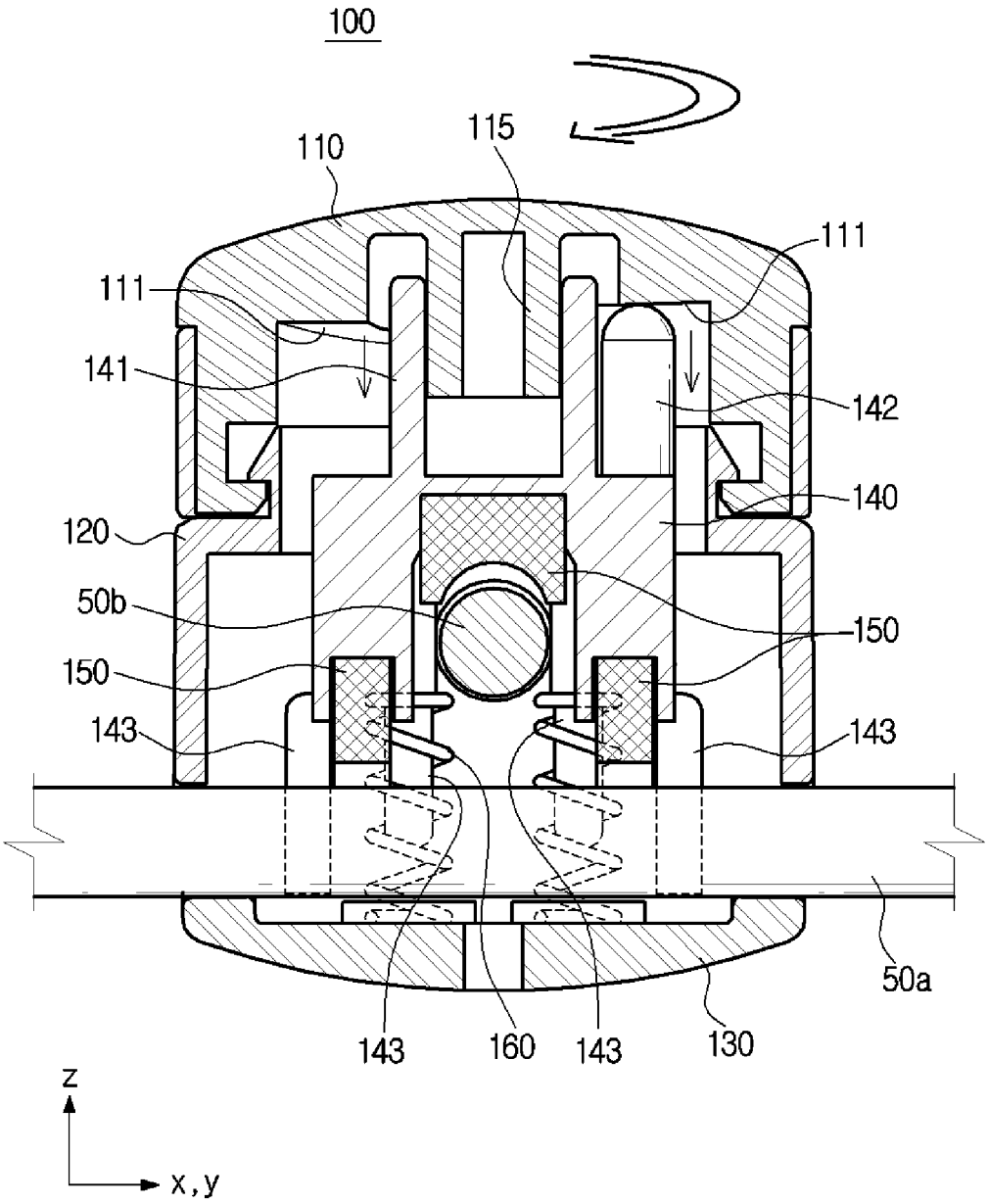
FIG. 12 is a cross-sectional view illustrating a state in which the moving guide rotates to fix the partition member according to various embodiments.

FIG. 12 is a cross-sectional view illustrating a state in which the moving guide 100 rotates to fix the partition member according to various embodiments.

The user can divide the storage space 21 into desired size spaces while moving the moving guide 100. When the desired spaces are formed, the user may fix the space to be unchanged by fixing the moving guide 100.

Referring to FIG. 12, as the upper portion 110 of the moving guide 100 rotates, the follower 142 may be away from the highest point of the inclined surface 111 and then gradually come in contact with points having a lower height. As the point in which the follower 142 is in contact with the inclined surface 111 is changed, the partition fixing portion 140 may gradually move downward in the Z axis direction.

As the partition fixing portion 140 gradually moves downward, the stopper 150 fastened to the partition fixing member 140 and the partition member 50 may gradually become closer. However, the moving guide 100 may be moved since the stopper 150 and the partition member 50 do not in contact with each other.

Figure 13:
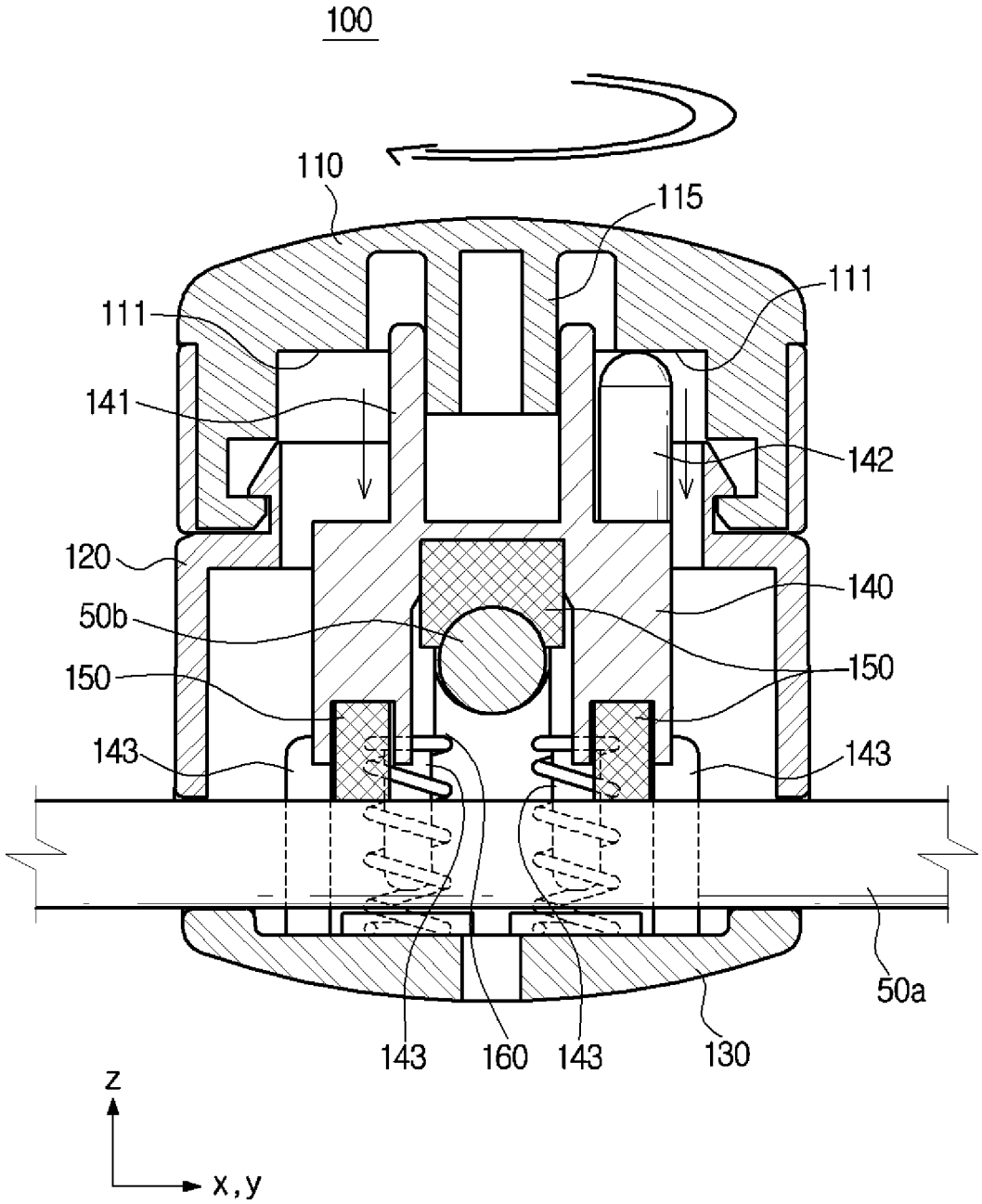
FIG. 13 is a cross-sectional view illustrating a state in which the moving member fixes the partition member according to various embodiments.

FIG. 13 is a cross-sectional view illustrating a state in which the moving member 100 fixes the partition member according to various embodiments.

Referring to FIG. 13, when the rotation of the upper portion 110 of the moving guide 100 is completed, the follower 142 may be in contact with the lowest point of the inclined surface 111, but is not limited thereto. For example, the follower 142 may be escaped from the inclined surface 111 and then in contact with the inner surface of the upper surface 117 of the upper portion 110 which is perpendicular to the Z-axis without the inclination.

When the follower 142 comes into contact with the lowest point of the inclined surface 111, the partition fixing member 140 may be placed at the lowest position among the positions in which the partition fixing portion 140 is movable along the Z axis. As the partition fixing member 140 is placed at the lowest position, the stopper 150 fastened to the partition fixing member 140 may be in contact with the partition member 50. In this case, the position fixing member 143 may be the closest to a lower inner side surface 139 of the partition fixing portion 140 of the moving guide 100, or may be in contact with the lower inner side surface 139.

Figure 14:
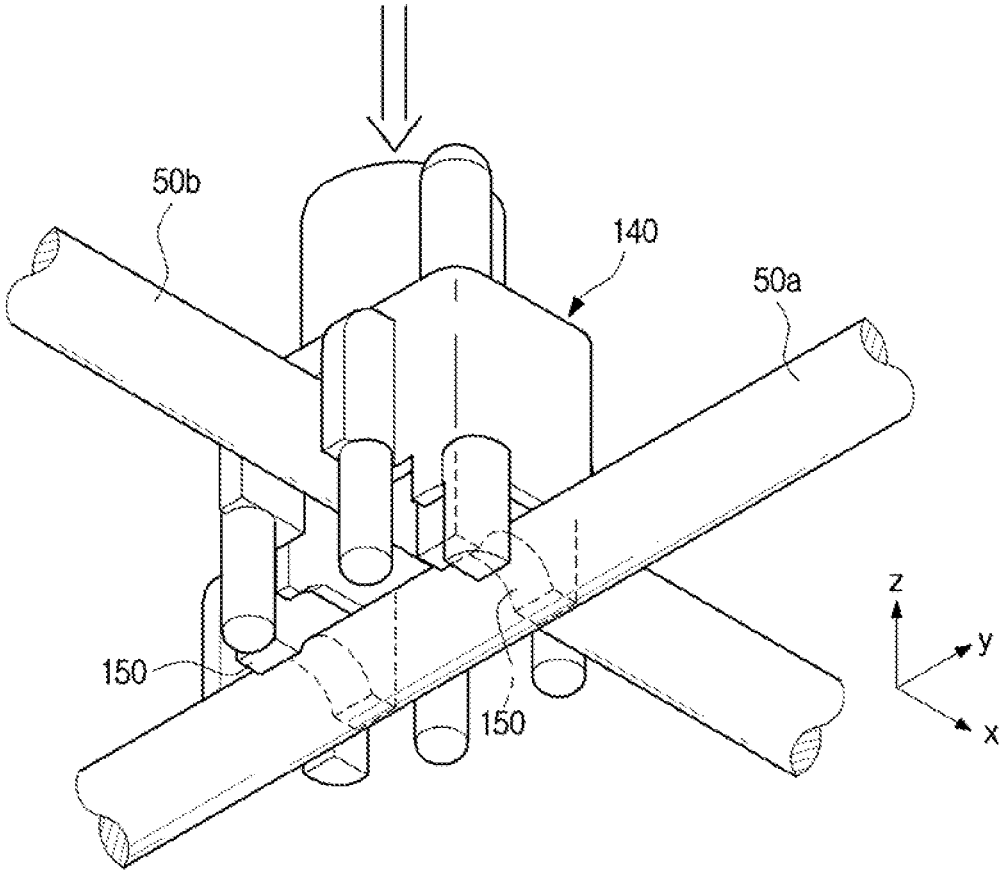
FIG. 14 is a perspective view illustrating a state in which the stopper is in contact with the partition member in the moving guide according to various embodiments.

FIG. 14 is a perspective view illustrating a state in which the stopper is in contact with the partition member in the moving guide 100 according to various embodiments.

Referring to FIG. 14, when the partition fixing member 140 is positioned at the lowest position as illustrated in FIG. 13, the stopper 150 fastened to the partition fixing member 140 may be in contact with the first partition member 50*a* and/or the second partition member 50*b*.

In this state, a user cannot freely adjust the size of the spaces generated by the first partition member 50*a* and the second partition member 50*a* in the storage space 21 by moving the moving guide 100, any more. Therefore, the user can store various products using the storage space 21 divided into a desired size.

Figure 15:
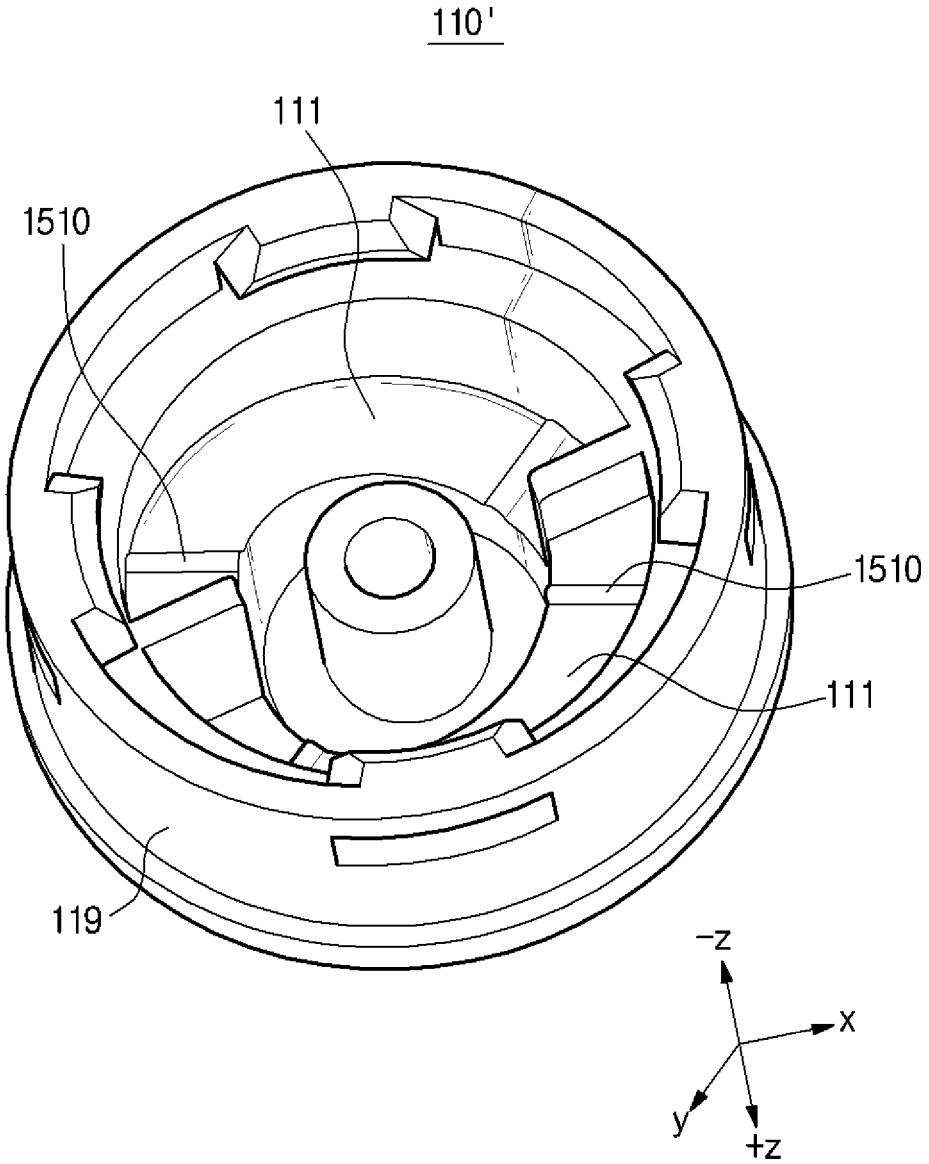
FIG. 15 is a perspective view illustrating an upper portion configured to inform a user when rotating in the first direction and the second direction in the moving guide according to various embodiments.

FIG. 15 is a perspective view illustrating an upper portion 110' configured to inform a user when rotating in the first direction and the second direction in the moving guide 100 according to various embodiments.

Referring to FIG. 15, an upper portion 110' of the moving guide 100 may include a central axis 115 fastened to the partition fixing portion 140 at a central portion thereof. The upper portion 110' may be one of various embodiments of the upper portion 110 of FIG. 6. The center axis 150 may be inserted into a circular groove 141 provided in the upper portion of the partition fixing portion 140. The upper portion 110' of the moving guide 100 may be rotated in the first and second direction with respect to the Z axis while the center axis 150 at the upper portion 110' of the moving guide 100 is inserted into the circular groove 141 of the partition fixing portion 140.

According to various embodiments, the upper portion 110' may form an inclined surface 111 inside of an upper surface 117. The height of the inclined surface may increase along the direction of rotation of the upper portion 110'. For example, the inclined surface 111 may be shaped such that the height of the inclined surface 111 increases gradually while drawing a circle toward the Y axis with respect to the X axis. At least one inclined surface 111 may be provided.

According to various embodiments, on the inclined surface 111, a locking protrusion 1510 may be formed toward the side surface 119 of the upper portion 110' in the central axis 115. For example, the locking protrusion 1510 may be provided adjacent to the lowest point of the inclined surface 111. Therefore, as the upper portion 110' of the moving guide 100 rotates, the follower 142 may move with the contact with the inclined surface 111, and then come into contact with the locking protrusion 1510 during the movement.

According to various embodiments, when the follower 142 is comes into contact with the locking protrusion 1510 and then separated from the locking protrusion 1510 as the upper portion 110' of the moving guide 100 continues to rotate, the partition fixing portion 140 may quickly move to the inclined surface 111 by the elastic force of the spring 160 inserted into the position fixing member 143. In this time, the follower 142 and the inclined surface 111 of the upper portion 110' may be collided with each other and thus the vibration and the noise may be generated.

According to various embodiments, the locking protrusion 1510 is adjacent to the lowest point of the inclined surface 111, the rotation of the partition fixing portion 140 may be completed right after the contact between the partition fixing portion 140 and the locking protrusion 1510 is released.

Therefore, when the collision sound is generated by the above mentioned operation during a user rotates the upper portion 110' of the moving guide 100 and then fix the moving guide 100, the user may recognize that the fixation of the moving guide 100 is completed.

Figure 16:
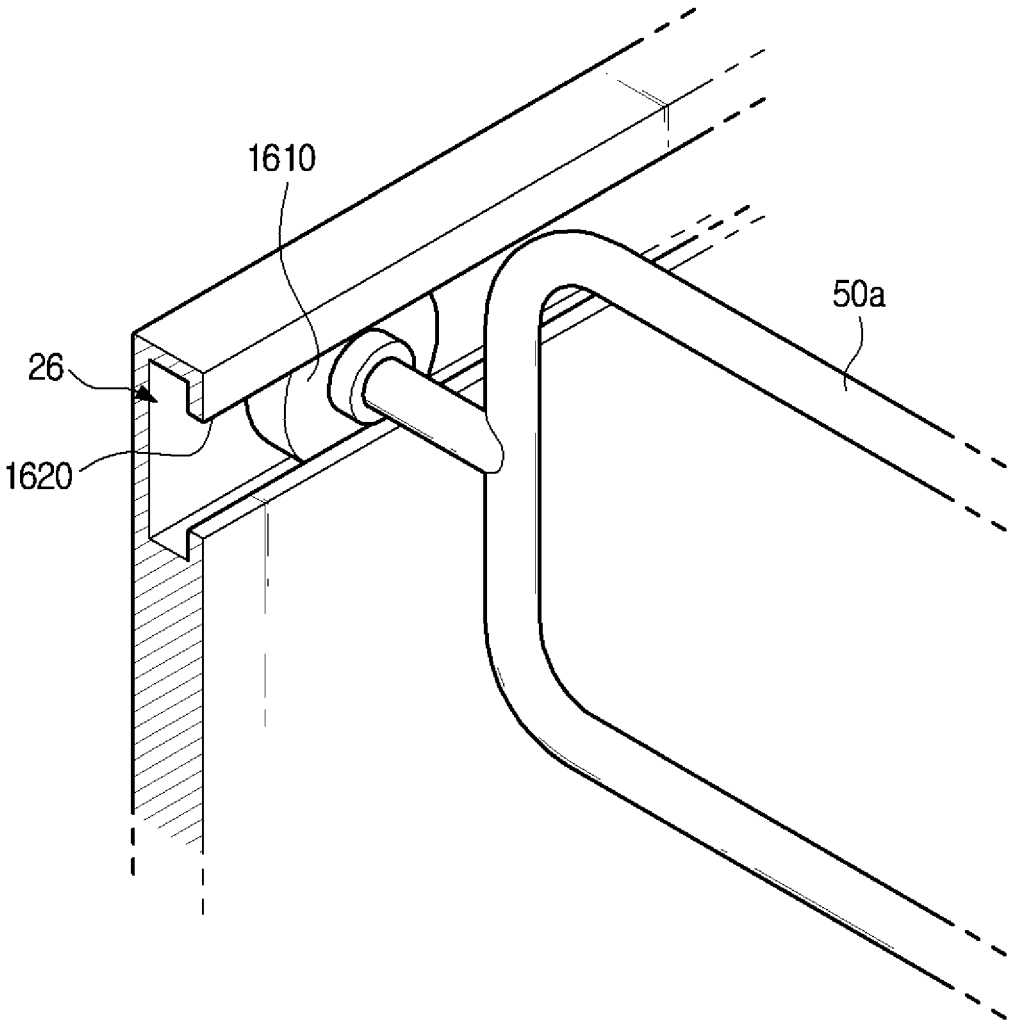
FIGS. 16 and 17 are perspective views illustrating the guide slot and the partition member in the storage container according to various embodiments.
Figure 17:
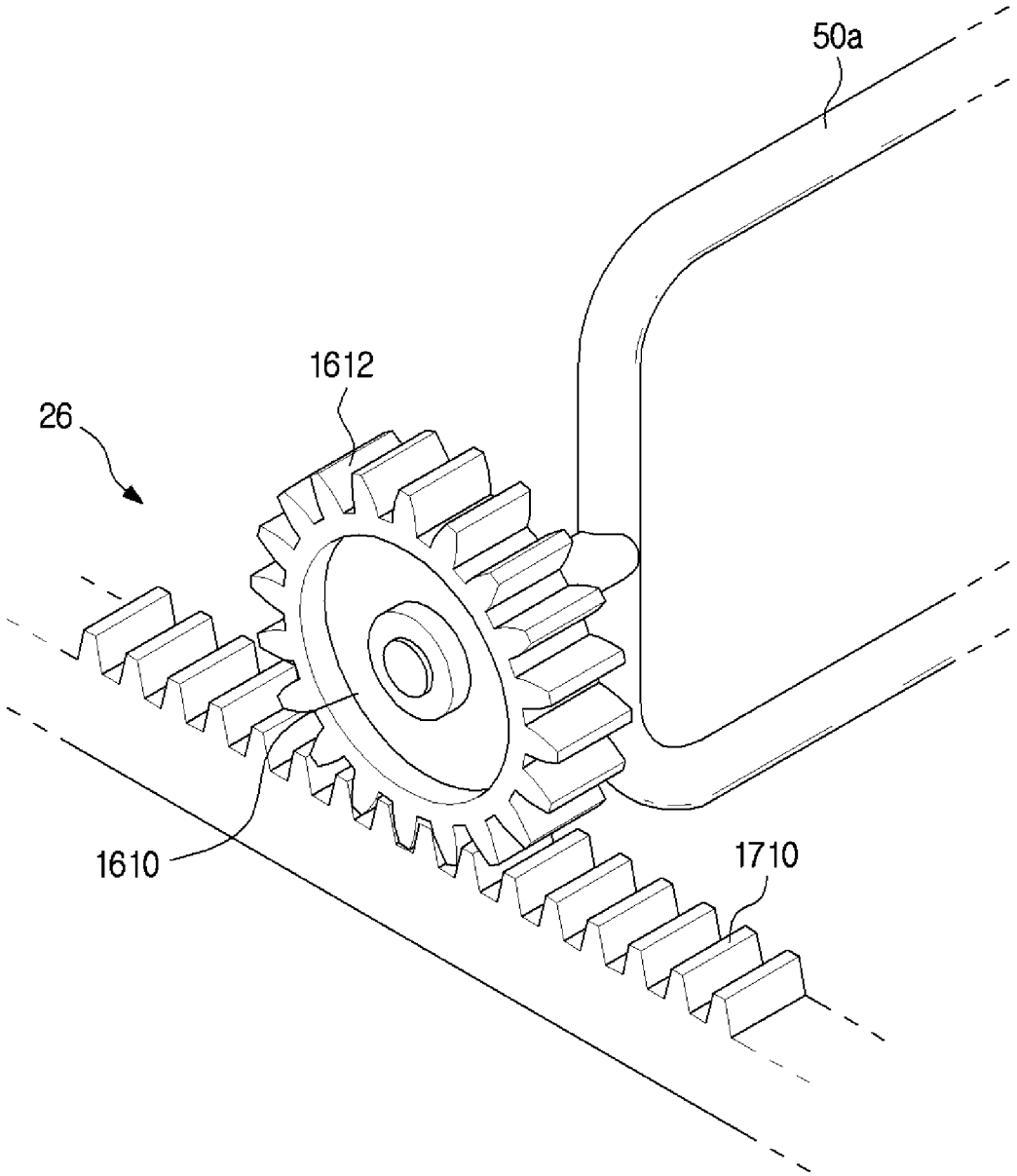

FIGS. 16 and 17 are perspective views illustrating the guide slot 26 and the partition member 50 in the storage container according to various embodiments.

FIG. 16 illustrates a roller 1610 provided in a cross-section of the guide slot 26 and the partition member 50.

The guide slot 26 is a concaved groove elongated formed in the horizontal direction on the wall surface of the storage container 20. The end portion of the first partition member 50*a* and the second partition member 50*b* may be coupled to the guide slot 26.

The roller 1610 may be provided in the end portion of the first partition member 50*a* and the second partition member 50*b* so as to move the first partition member 50*a* and the second partition member 50*b* in the horizontal direction by rotating along the guide slot 26. It may be appropriate that an inlet 1620 of the guide slot 26 is smaller than the roller 1610 so that the roller 1610 coupled to the guide slot 26 is prevented from escaping.

Referring to FIG. 17, an uneven portion 1710 may be formed on a surface in contact with an outer circumferential surface of the roller 1610 of the guide slot 26. When the size of the uneven portion 1710 is similar to the size of the roller 1610, the roller 1610 may be placed in the concave portion of the uneven portion 1710 and thus the roller 1610 may be gradually moved by an interval of the uneven portion 1710 without being continuously moved. When the size of the uneven portion 1710 is small, a tooth 1612 may be formed on an outer circumferential surface of the roller 1610. As the tooth 1612 is engaged with the uneven portion 1710 and then rotated, the roller 1610 may be moved.

When the uneven portion 1710 is formed in the guide slot 26, it is possible to improve the efficiency of the fixation of the partition member 50 because the movement of the roller 1610, which is not intended by a user, is prevented.

Figure 18:
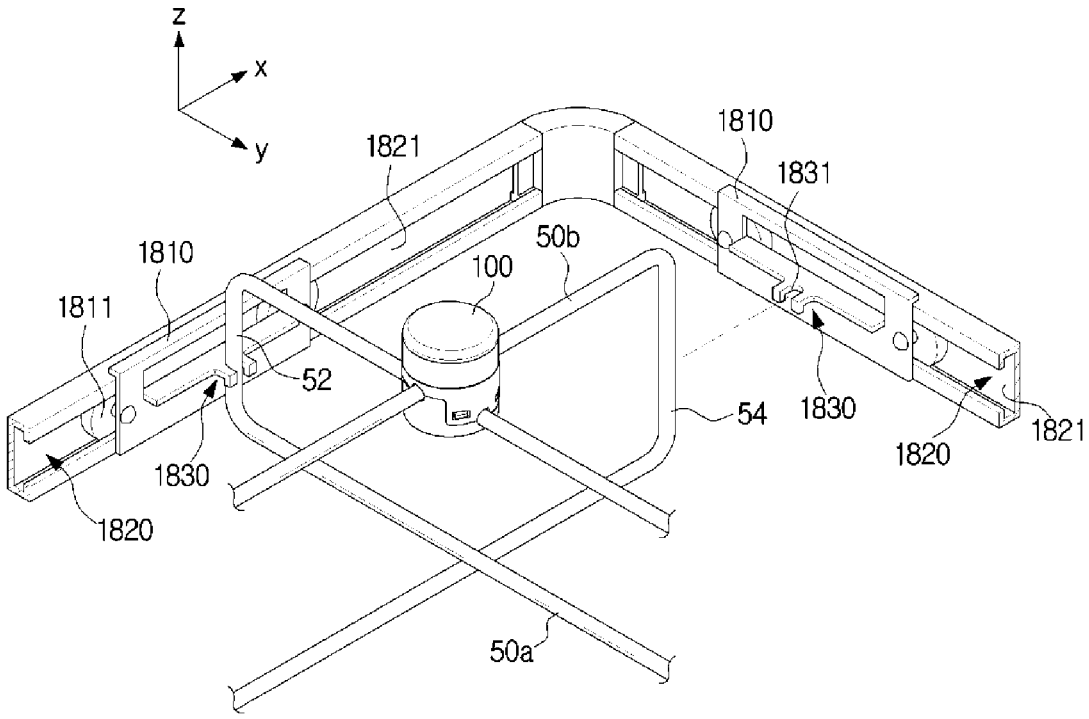
FIG. 18 is a perspective view illustrating another structure to move the partition member in the storage container according to various embodiments.

FIG. 18 is a perspective view illustrating another structure to move the partition member 50 in the storage container according to various embodiments.

Referring to FIG. 18, the storage container 20 may include a sliding member 1810 provided in a wall surface thereof, and a guide member 1820 to which the sliding member 1810 is movably coupled to guide the stable linear movement of the sliding member 1810. According to various embodiments, the guide member 1820 may be formed of a material having the relatively large rigidity as to prevent the shaking caused by the deformation upon movement of the sliding member 1810.

According to various embodiments, the sliding member 1810 may be formed in a substantial rectangular plate shape. The sliding member 1810 may be coupled to each vertical rod 52 and 54 of the first partition member 50*a* and the second partition member 50*b*. For this, a coupling portion 1830 coupled to each vertical rod 52 and 54 of the first partition member 50*a* and the second partition member 50*b* may be provided in one side of the sliding member 1810.

The coupling portion 1830 may have any shape as long as a structure capable of detachably mounting the sliding member 1810 to the partition member 50 so that the sliding member 1810 is attachable to or detachable from the partition member 50. For example, the coupling portion 1830 may include an indentation groove 1831 opened in the vertical direction so that the each vertical rod 52 and 54 of the first partition member 50*a* and the second partition member 50*b* is press-coupled thereto.

Accordingly, the each vertical rod 52 and 54 of the first partition member 50*a* and the second partition member 50*b* may be pressed in the indentation groove 1831 of the sliding member 1810 so that the first partition member 50*a* and the second partition member 50*b* are easily coupled to the sliding member 1810.

When the vertical rod 52 and 54 is press-coupled to the indentation groove 1831 opened in the vertical direction, a position in which the press-coupling is performed may vary among positions in the longitudinal direction of the vertical rod 52 and 54. Therefore, the height of the partition member 50 may be adjusted according to the storage space 21 of the storage container 20.

According to various embodiments, the guide member 1820 may include a guide groove 1821 elongated with a predetermined depth in the direction perpendicular to the Z axis, wherein the guide groove 1821 is configured to guide the prior movement of the sliding member 1810.

The guide groove 1821 may be provided to allow the sliding member 1810 to be inserted thereto so that the sliding member 1810 is movable along the guide groove 1821. In this case, a roller 1811 rotatably coupled to the other side of the sliding member 1810 may be provided and thus the roller 1811 is in contact with the upper and lower surface of the inside of the guide groove 1821 while rolling.

According to various embodiments, the sliding member 1810 is configured to be detachably mounted to the partition member 50 so that the sliding member 1810 is attachable to or detachable from the partition member 50, but is not limited thereto. The sliding member 1810 may be integrally formed with the partition member 50.

According to various embodiments, the storage container 20 may be provided with the guide member 1820 and the sliding member 1810 on the wall surface thereof, as illustrated in FIG. 18, but the guide member 1820 and the sliding member 1810 may be placed inside of the guide slot 26. In this case, the coupling portion 1830 may be placed outside of the guide slot 26 and then coupled to the partition member 50.

Figure 19:
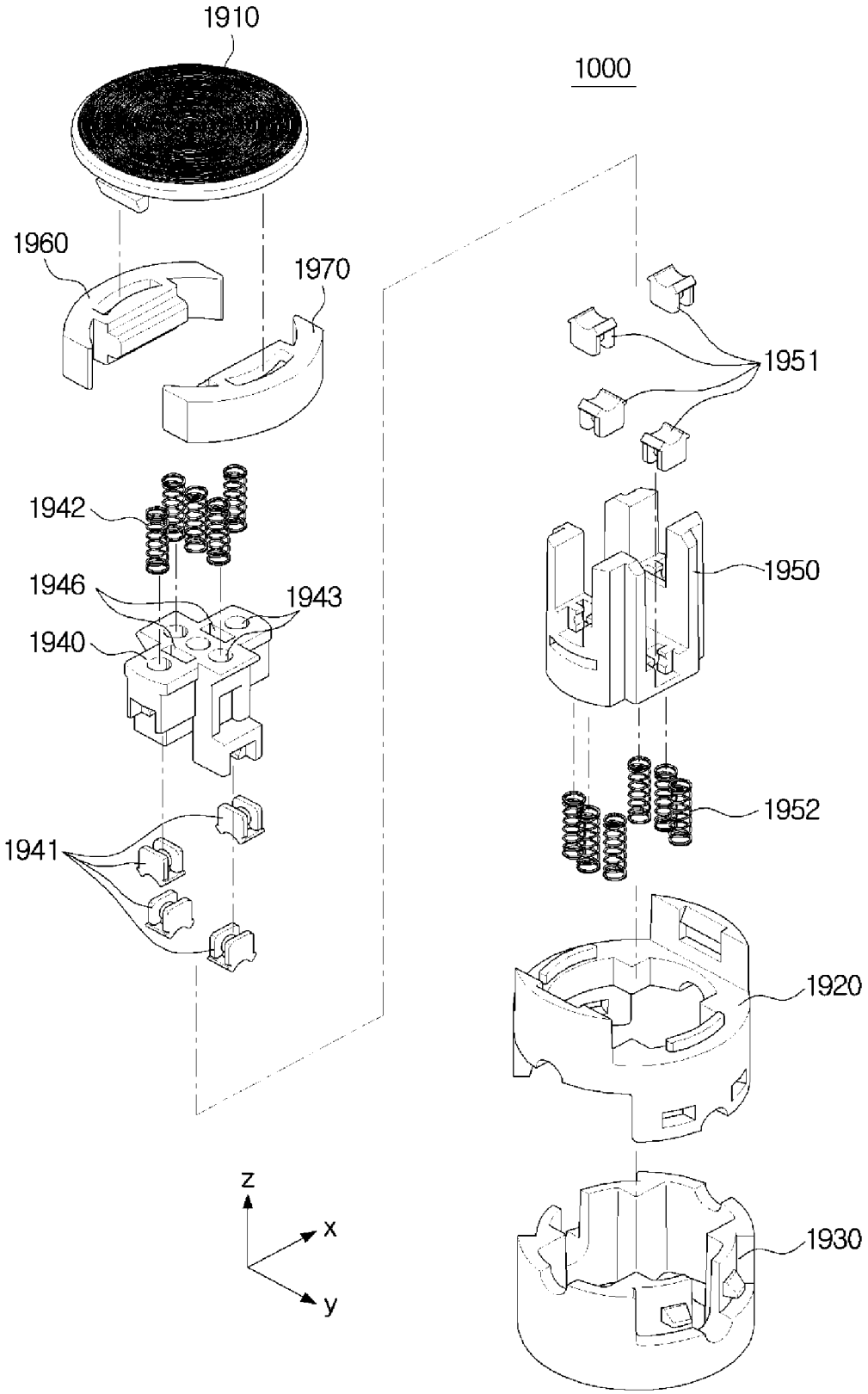
FIG. 19 is an exploded-perspective view illustrating a moving guide according to another embodiment of the present disclosure.
Figure 20:
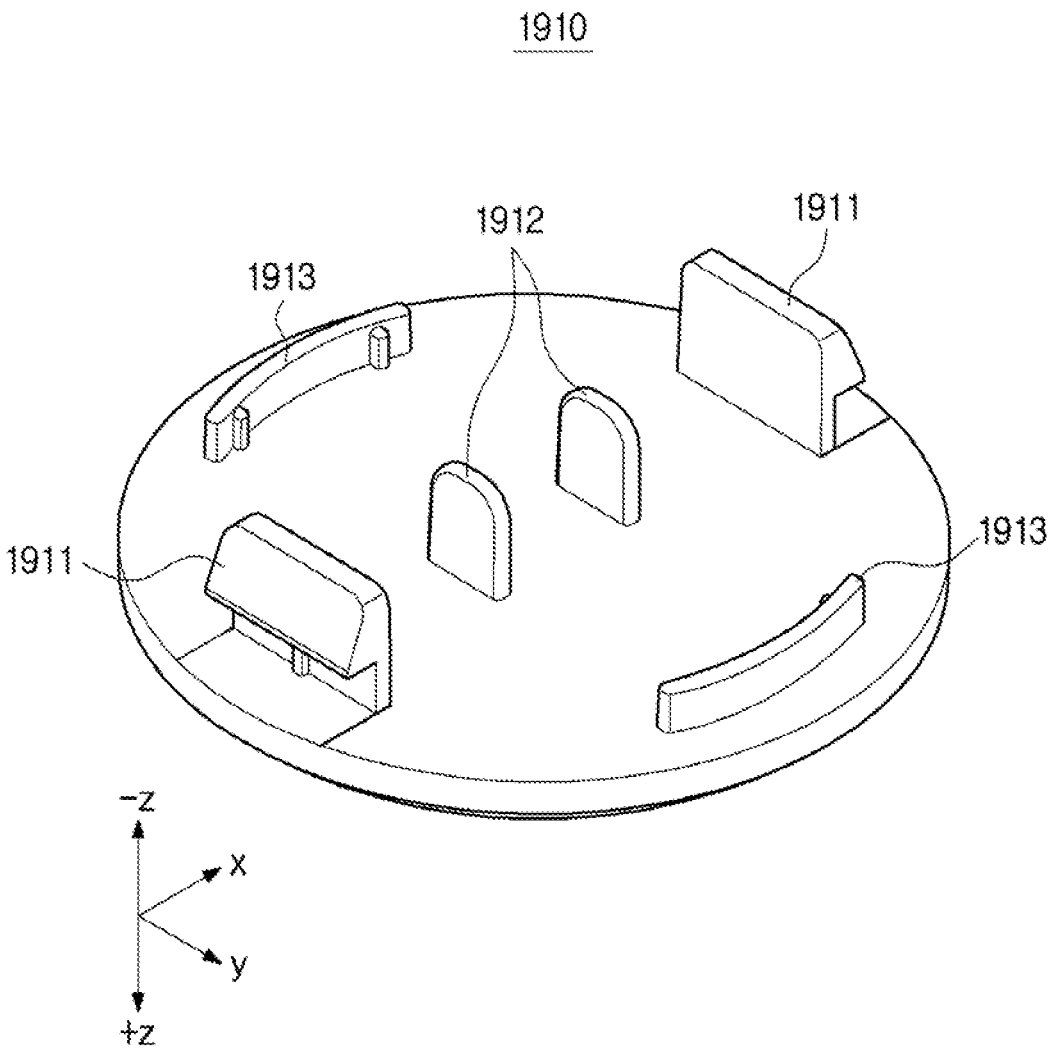
FIG. 20 is a perspective view illustrating an upper portion of the moving guide according to various embodiments.
Figure 21:
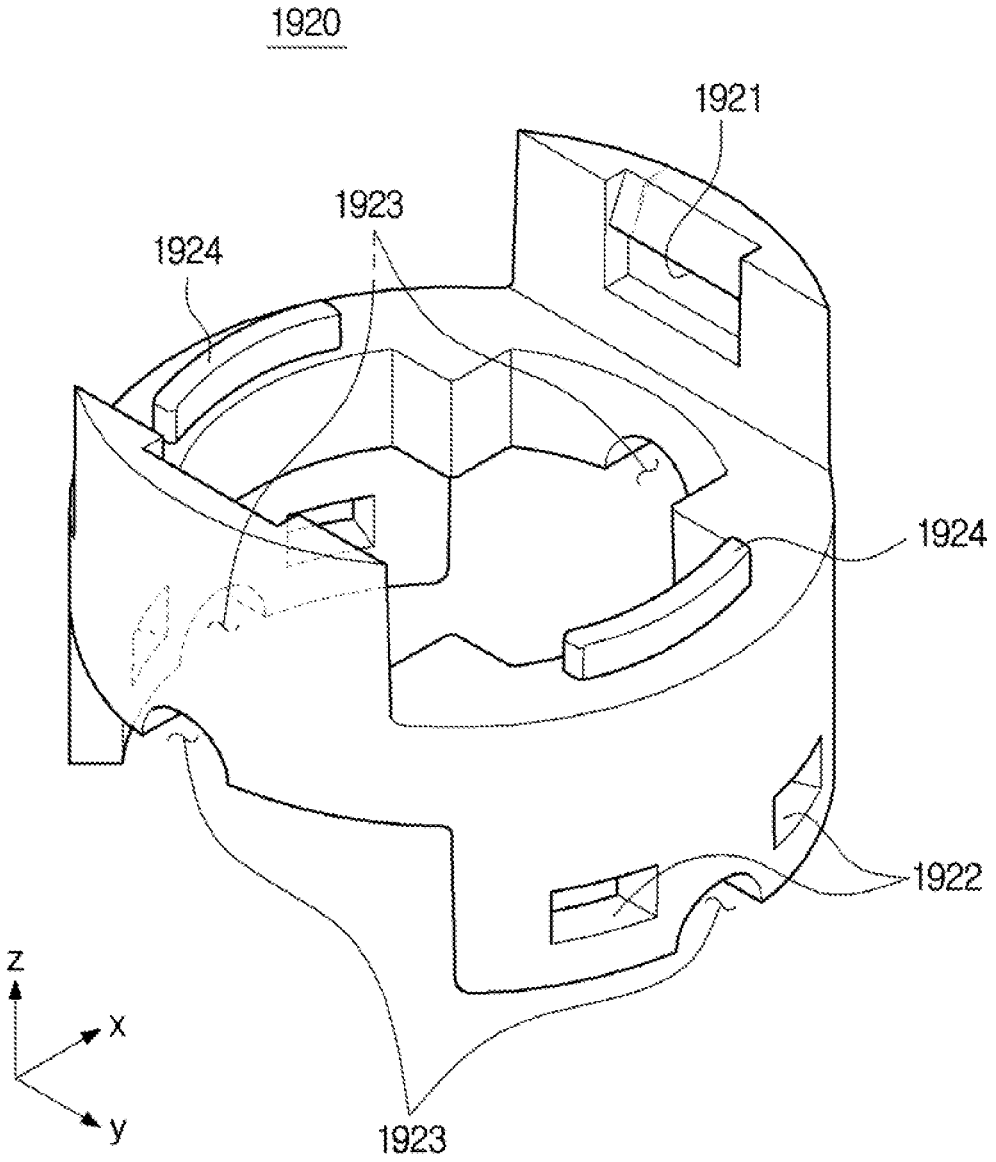
FIG. 21 is a perspective view illustrating a middle portion of the moving guide according to various embodiments.
Figure 22:
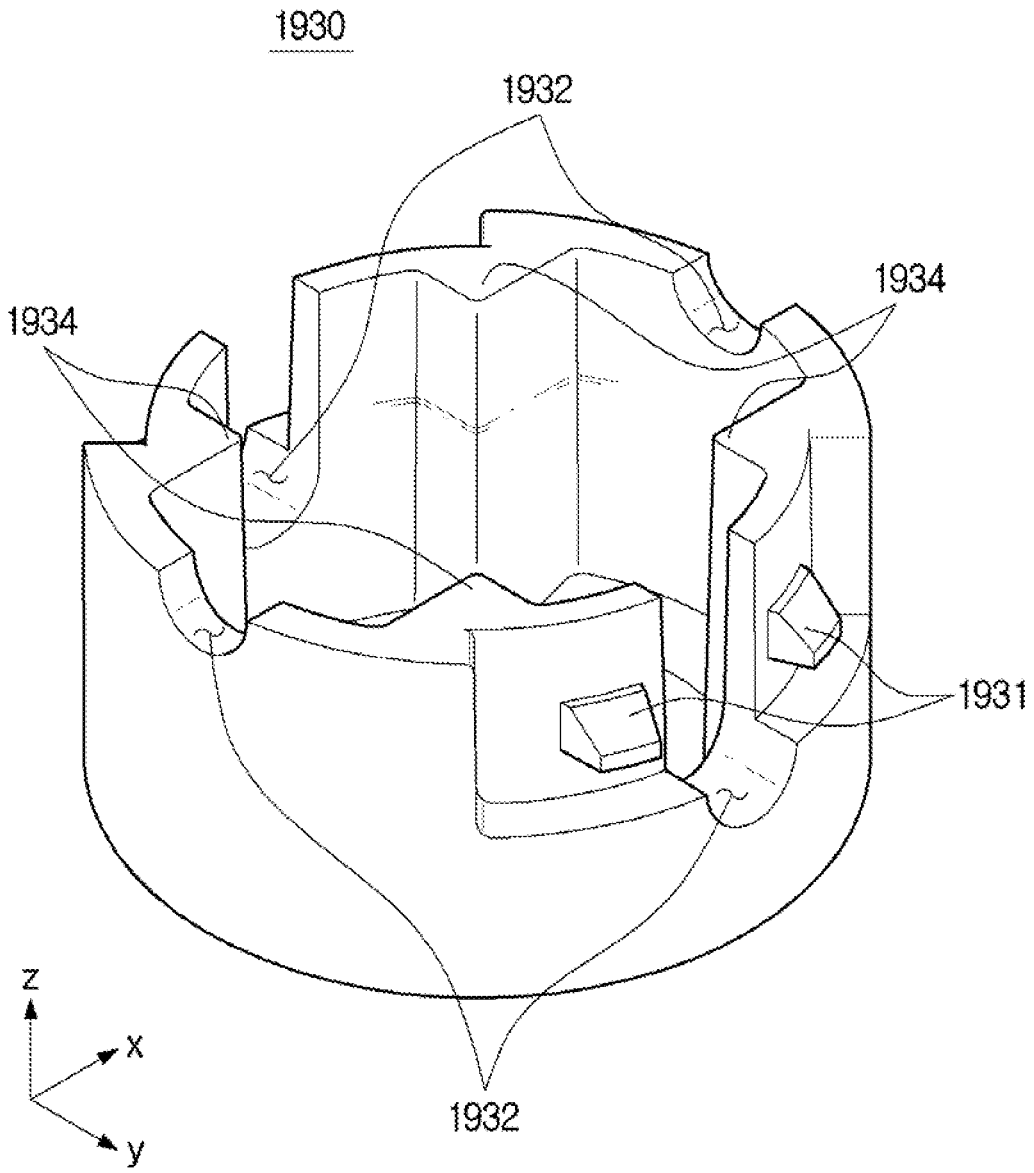
FIG. 22 is a perspective view illustrating a lower portion of the moving guide according to various embodiments.

FIG. 19 is an exploded-perspective view illustrating a moving guide 1000 according to another embodiment of the present disclosure. FIG. 20 is a perspective view illustrating an upper portion of the moving guide 1000 according to various embodiments. FIG. 21 is a perspective view illustrating a middle portion of the moving guide 1000 according to various embodiments. FIG. 22 is a perspective view illustrating a lower portion of the moving guide 1000 according to various embodiments. FIG. 23 is a perspective view illustrating a partition fixing portion provided on the inside of the moving guide 1000. FIG. 24 is a perspective view illustrating a lever according to various embodiments. Hereinafter a configuration of the moving guide 1000 will be described with reference to FIGS. 19 to 24.

Referring to FIG. 19, according to various embodiments, the moving guide 1000 may include an upper portion 1910, a middle portion 1920 and a lower portion 1930 forming a through hole by being coupled to the middle portion 1920, wherein a first partition and a second partition are passed the through hole.

The moving guide 1000 may further include a first partition fixing portion 1940, a second partition fixing portion 1950, a first lever 1960, a second lever 1970, a first stopper 1941 and the second stopper 1951 coupled the first partition fixing portion 1940 and the second partition fixing portion 1950, all of which are placed inside of the upper portion 1910, the middle portion 1920 and the lower portion 1930.

In the moving guide 1000, the upper portion 1910, the middle portion 1920, the lower portion 1930 and the first and second partition fixing portion 1940 and 1950 to which the first and second stopper 1941 and the second stopper 1951 is coupled may be coupled to each other in the Z axis. In a state in which each component of the moving guide 1000 is coupled to each other, the first lever 1960 and the second lever 1970 may be movable in the XY plane, and the first and second partition fixing portion 1940 and 1950 may be vertically movable in the Z axis direction, according to the movement of the first lever 1960 and the second lever 1970.

FIG. 20 is a perspective view illustrating the upper portion 1910 of the moving guide 1000 according to various embodiments.

Referring to FIG. 20, the upper portion 1910 of the moving guide 1000 may include a hook protrusion 1911 formed in an edge portion of the inner surface thereof to be engaged with the middle portion 1920. The hook protrusion 1911 may be inserted into a hook groove 1921 provided in a side surface of an upper portion of the middle portion 1920. The upper portion 1910 and the middle portion 1920 may be coupled to each other by the hook protrusion 1911 and the hook groove 1921.

According to various embodiments, an uneven portion 1912 may be formed in the inner side of the upper portion 1910. The uneven portion 1912 may be engaged with an upper portion coupling groove 1946 formed in the upper portion of the first partition fixing portion 1940 to fix a position of a spring 1942 in a state in which the spring 1942 inserted into the first partition fixing portion 1940 comes into contact with the upper portion 1910.

The upper portion 1910 may be provided with a lever insertion protrusion 1913 formed in the other edge portion different from the edge portion in which the hook protrusion 1911 is formed, and configured to be coupled to the lever 1960 and 1970.

FIG. 21 is a perspective view illustrating the middle portion 1920 of the moving guide 1000 according to various embodiments.

Referring to FIG. 21, according to various embodiments, the middle portion 1920 of the moving guide 1000 may include the hook groove 1921 formed in the upper portion thereof and configured to be coupled to the upper portion 1910 of the moving guide 1000, a coupling groove 1922 coupled to the lower portion 1930 of the moving guide 1000, and semicircular spaces 1923 through which the first partition member 50*a* and the second partition member 50*a* are passed when the middle portion 1920 is coupled to the lower portion of the moving guide 1000.

The semicircular spaces 1923 may form a through hole through which the first partition member 50*a* and the second partition member 50*b* are passed, by being in contact with semicircular spaces 1932 provided on the side surface of the lower portion 1930 of the moving guide 1000. According to various embodiments, a through hole in which the first partition member 50*a* is located may be a first through hole, and a through hole in which the second partition member 50*a* is located may be a second through hole, but is not limited thereto.

The middle portion 1920 may be provided with a lever insertion protrusion 1924 formed in a position different from the position in which the hook groove 1921 is provided, and configured to be coupled to the lever 1960 and 1970.

FIG. 22 is a perspective view illustrating a lower portion 1930 of the moving guide 1000 according to various embodiments.

Referring to FIG. 22, according to various embodiments, the lower portion 1930 of the moving guide 1000 may include a middle portion coupling protrusion 1931 formed in the side surface thereof to be coupled to the middle portion 1920 of the moving guide 1000. The lower portion 1930 may further include a second protrusion 133 formed in the direction perpendicular to the Z axis along the outer surface of a second coupling portion 132.

The lower portion 1930 of the moving guide 1000 may be provided with semicircular spaces 1932 formed in the side surface thereof and through which the first partition member 50*a* and the second partition 50*b* are passed. The semicircular spaces 1932 may form a through hole through which the first partition member 50*a* and the second partition member 50*b* are passed, by being in contact with semicircular spaces 1923 provided on the side surface of the middle portion 1920 of the moving guide 1000.

According to various embodiments, the first partition member 50*a* may be inserted into the first through-hole, and the second partition 50*b* may be inserted into the second through hole, but is not limited thereto.

According to various embodiments, an uneven portion 1934 configured to be in contact with a groove 1956 formed on the outside of the second partition fixing portion 1950 may be formed on an inner surface of the lower portion 1930 of the moving guide 1000. When the second partition fixing portion 1950 vertically moves in the Z axis, the groove 1956 and the uneven portion 1934 may allow the second partition fixing portion 1950 to move without shaking in the left and right side.

FIG. 23 is a perspective view illustrating the first partition fixing portion 1940 and the second partition fixing portion 1950 provided in the inside of the moving guide 1000 according to various embodiments.

Figure 23A:
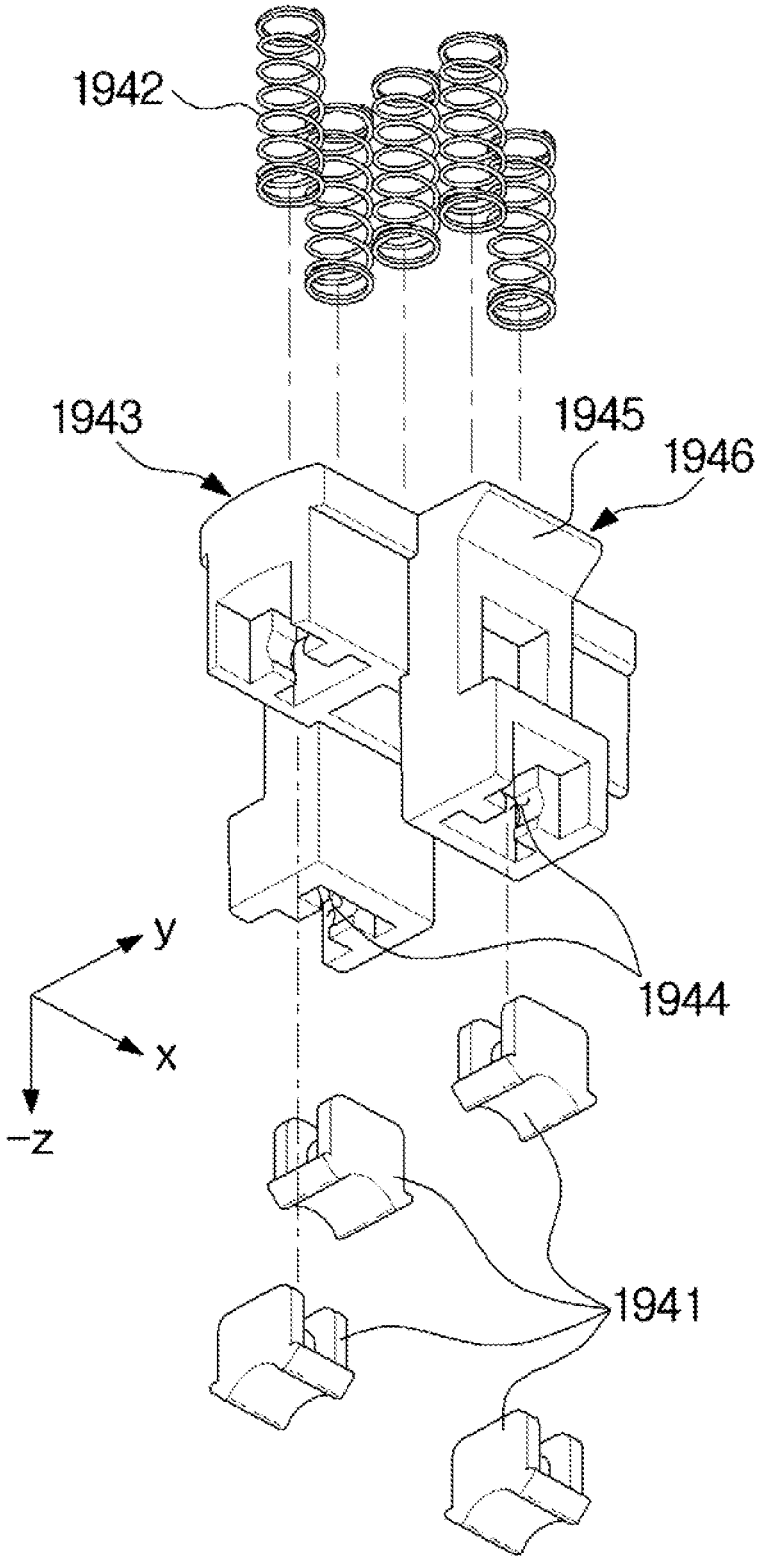
FIGS. 23A and 23B are a perspective view illustrating a partition fixing portion provided in the inside of the moving guide.

Referring to FIG. 23A, according to various embodiments, the first partition fixing portion 1940 may include a spring insertion hole 1943 into which the spring 1942, which is in contact with the inner side of the upper portion 1910 of the moving guide 1000, is inserted and a stopper coupling groove 1944 to which the first stopper 1941 is coupled.

The spring 1942 may be inserted into the spring insertion hole 1943 of the first partition fixing portion 1940. The spring 1942 may provide the force capable of pushing the first partition fixing portion 1940 in the direction that is away from the upper portion 1910. In this case, the first partition fixing portion 1940 may be vertically movable in the Z axis direction according to the movement of the lever 1960 and 1970.

According to various embodiments, the first partition fixing portion 1940 may include an inclined surface 1945. The inclined surface 1945 may come into contact with a first inclined surface 1961 and 1971 of the lever 1960 and 1970. Therefore, as the lever 1960 and 1970 is moved in the left and right side in the XY plane, it may be possible to apply a force to the inclined surface 1945 of the first partition fixing portion 1940 in contact with the first inclined surface 1961 and 1971 of the lever 1960 and 1970. By the force applied to the first inclined surface 1961 and 1971 of the lever 1960 and 1970, the first partition fixing portion 1940 may be moved to the upper side along the Z axis.

According to various embodiments, the stopper 1941 may be coupled to the stopper coupling groove 1944 of the first partition fixing portion 1940. A contact surface of the stopper 1941 may be formed of a material having the high frictional force, e.g., silicon material and rubber material, but is not limited thereto. The shape of the surface in contact with the stopper 1941 may be similar to the appearance of the partition member 50. For example, the partition member 50 is formed in the cylindrical shape, the shape of the surface in contact with the stopper 1941 may have a rounded shape according to the appearance of the cylinder.

The stopper 1941 may be not in contact or be in contact with the partition member 50 according to the vertical movement of the first partition fixing portion 1940. For example, when the first partition fixing portion 1940 descends along the Z axis, the stopper 1941 may be in contact with the partition member 50. Thus, the position of the moving guide 1000 may be fixed together with the partition member 50.

When the first partition fixing portion 1940 ascends along the axis Z, the contact between the stopper 1941 and the partition member 50 may be released. Accordingly, the position of the moving guide 1000 may be changed. Therefore, the user can change the size of all the storage space generated by the partition member 50.

Figure 23B:
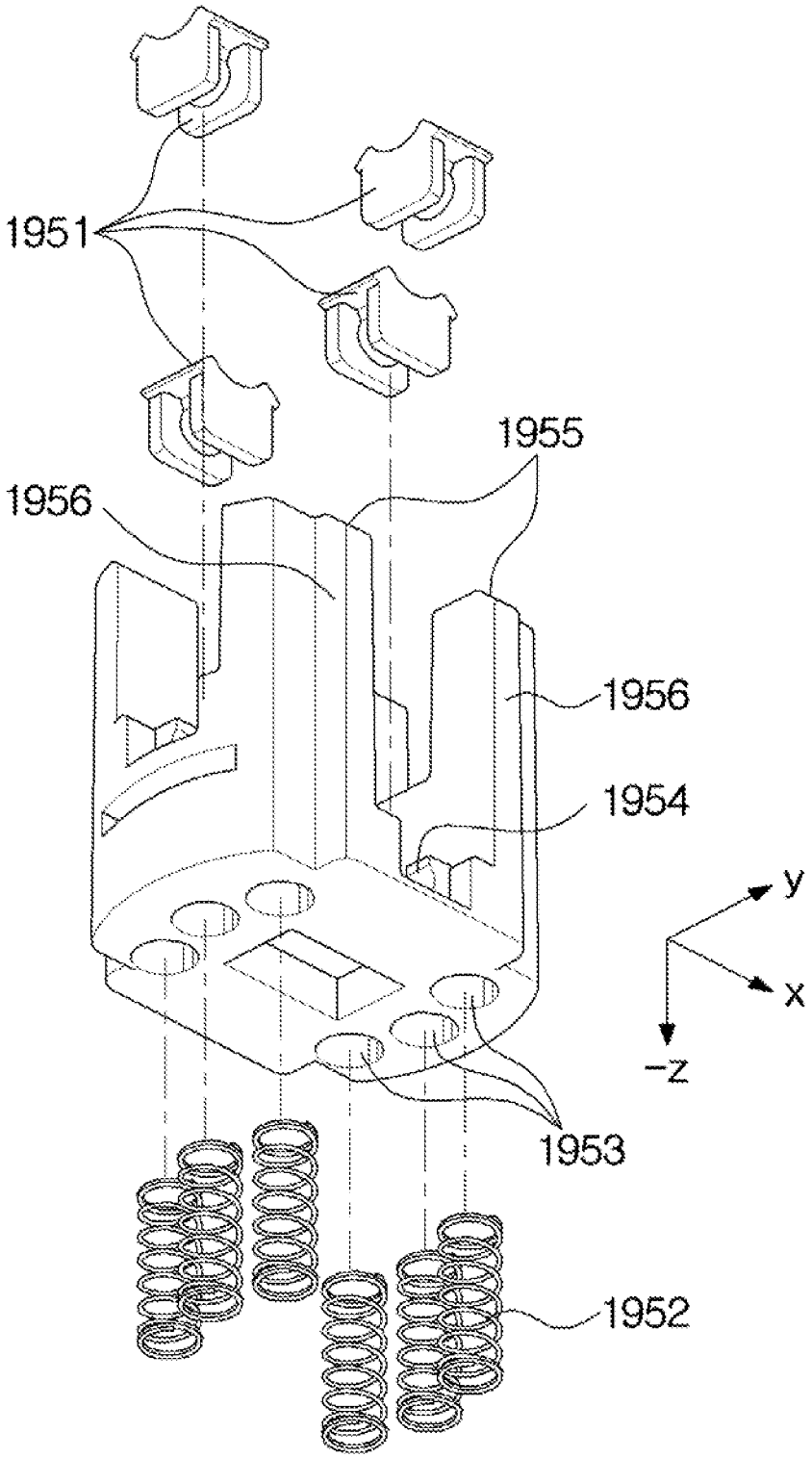

Referring to FIG. 23B, according to various embodiments, the second partition fixing portion 1950 may include a spring insertion hole 1953 into which the spring 1952, which is in contact with the inner side of the lower portion 1930 of the moving guide 1000, is inserted and a stopper coupling groove 1954 to which the second stopper 1951 is coupled.

The spring 1952 may be inserted into the spring insertion hole 1953 of the second partition fixing portion 1950. The spring 1952 may be in contact with a lower surface of the lower portion 1930. In this case, the second partition fixing portion 1950 may be vertically movable in the Z axis direction according to the movement of the lever 1960 and 1970.

According to various embodiments, the second partition fixing portion 1950 may include an inclined surface 1955. The inclined surface 1955 may come into contact with a second inclined surface 1962 and 1972 of the lever 1960 and 1970. Therefore, as the lever 1960 and 1970 is moved in the left and right side in the XY plane, it may be possible to apply a force to the inclined surface 1955 of the second partition fixing portion 1950 in contact with the second inclined surface 1962 and 1972 of the lever 1960 and 1970. By the force applied to the second inclined surface 1962 and 1972 of the lever 1960 and 1970, the second partition fixing portion 1950 may be moved to the lower side along the Z axis.

According to various embodiments, the stopper 1951 may be coupled to the stopper coupling groove 1954 of the second partition fixing portion 1950. The shape of the surface in contact with the stopper 1951 may be similar to the appearance of the partition member 50. For example, the partition member 50 is formed in the cylindrical shape, the shape of the surface in contact with the stopper 1951 may have a rounded shape according to the appearance of the cylinder.

The stopper 1951 may be not in contact or be in contact with the partition member 50 according to the vertical movement of the second partition fixing portion 1950. For example, when the second partition fixing portion 1950 ascends along the Z axis, the stopper 1951 may be in contact with the partition member 50. Thus, the position of the moving guide 1000 may be fixed together with the partition member 50.

When the second partition fixing portion 1950 descends along the axis Z, the contact between the stopper 1951 and the partition member 50 may be released. Accordingly, the position of the moving guide 1000 may be changed. Therefore, the user can change the size of all the storage space generated by the partition member 50.

FIG. 24 is a perspective view illustrating the lever coupled to the side surface of the moving guide 1000 according to various embodiments.

Figure 24A:
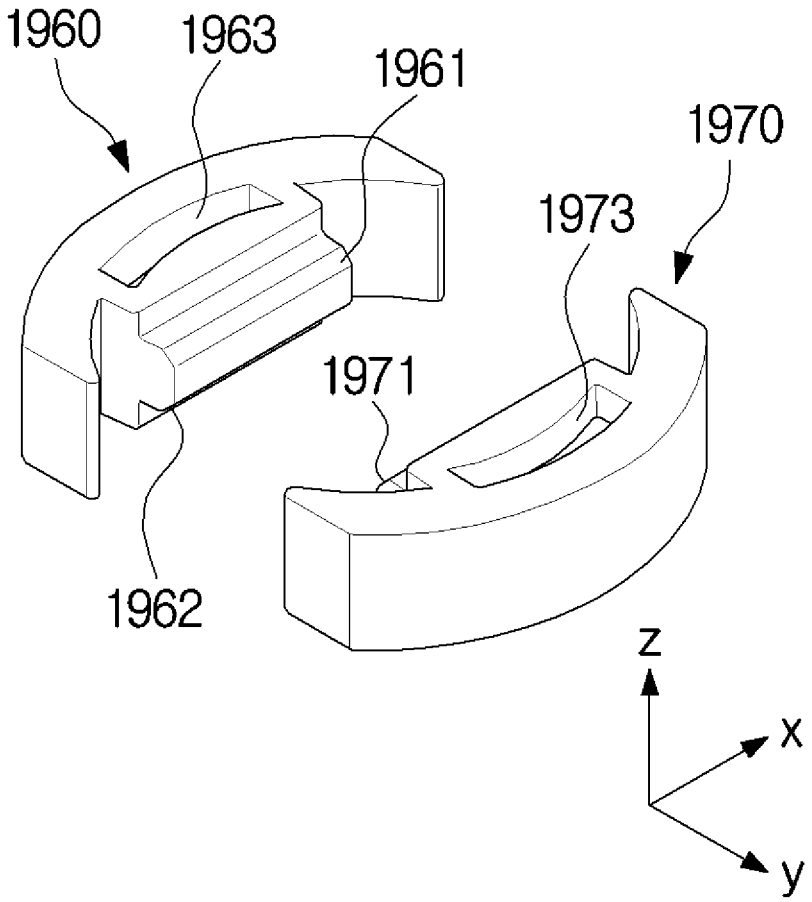
FIGS. 24A and 24B are a perspective view illustrating a lever according to various embodiments.
Figure 24B:
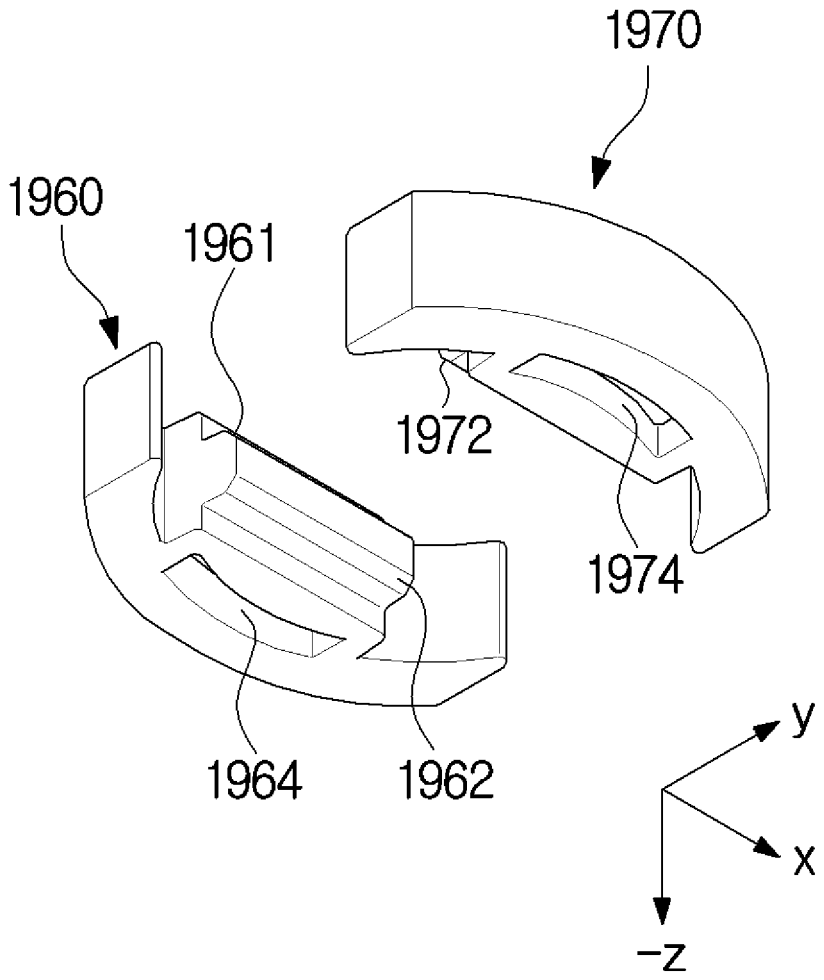

FIG. 24A is a perspective view of the lever 1960 and 1970 when viewed from above, and FIG. 24B is a perspective view of the lever 1960 and 1970 when viewed from below.

Referring to FIGS. 24A and 24B, the lever 1960 and 1970 may include the first inclined surface 1961 and 1971, the second inclined surface 1962 and 1972, an upper portion coupling groove 1963 and 1973 coupled to the lever insertion protrusion 1913 of the upper portion 1910, and a middle portion coupling groove 1964 and 1974 coupled to the lever insertion protrusion 1924 of the middle portion 1920.

The lever 1960 and 1970 may be coupled to the upper portion 1910 and the middle portion 1920 such that the upper portion coupling groove 1963 and 1973 are coupled to the lever insertion protrusion 1913 of the upper portion 1910 and the middle portion coupling groove 1964 and 1974 are coupled to the lever insertion protrusion 1924 of the middle portion 1920.

In a state in which all components of the moving guide 1000 is coupled to each other, when a user moves the lever to the inside of the moving guide 1000, the lever 1960 and 1970 may push the inclined surface of the inclined surface 1945 of the first partition fixing portion 1940 and the inclined surface 1955 of the second partition fixing portion 1950 to move the first partition fixing portion 1940 to the upper side and to move the second partition fixing portion 1950 to the lower side. In this time, the contact between the partition member 50, and the first partition fixing portion 1940 and the second partition fixing portion 1950 may be released, and the user may easily adjust the size of the space generated by the partition member 50, by using the moving guide 1000.

Figure 25A:
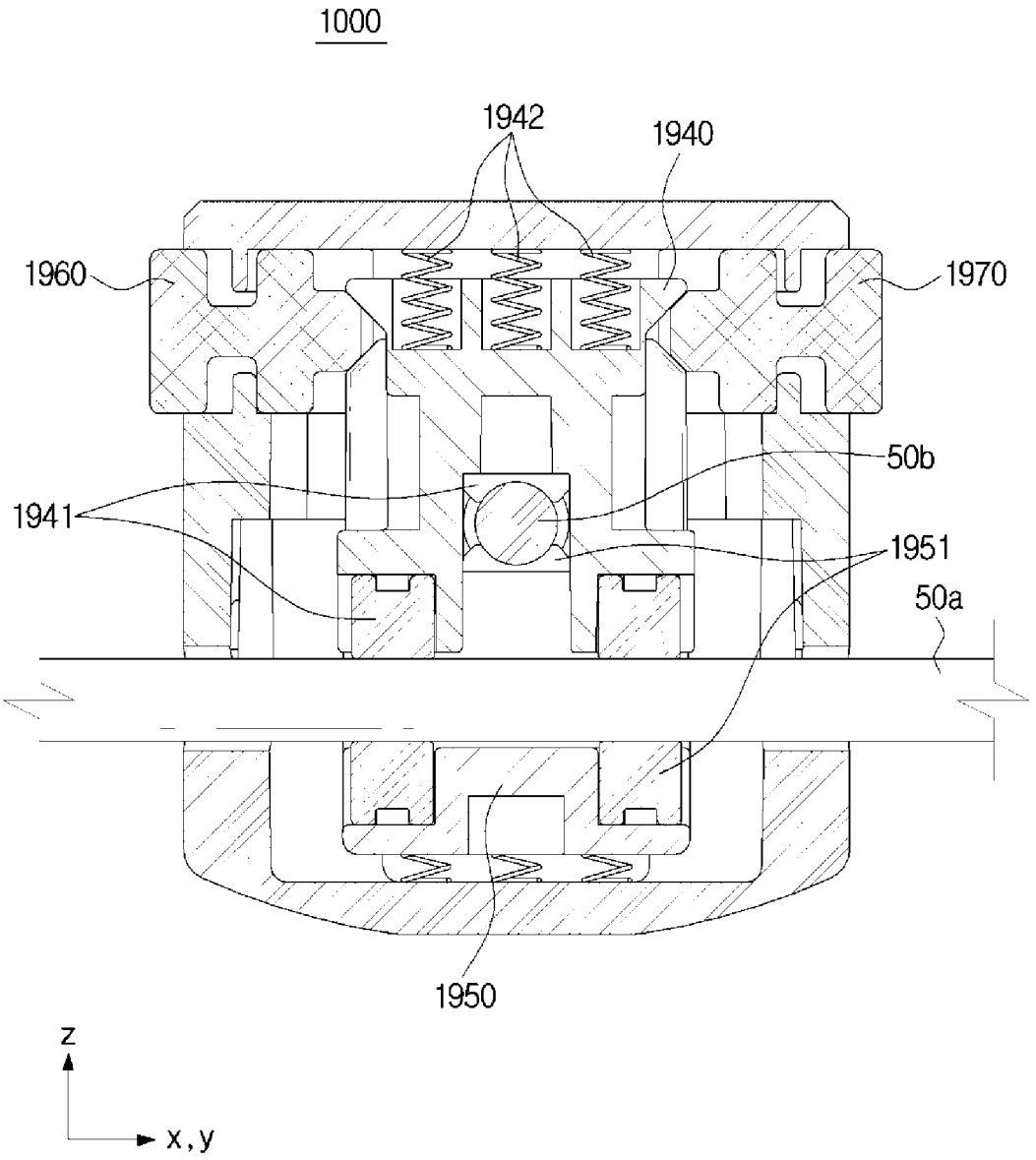
FIGS. 25A and 25B are cross-sectional views illustrating a process in which the partition member is changed from a fixed state to a non-fixed state in the moving guide according to various embodiments.
Figure 25B:
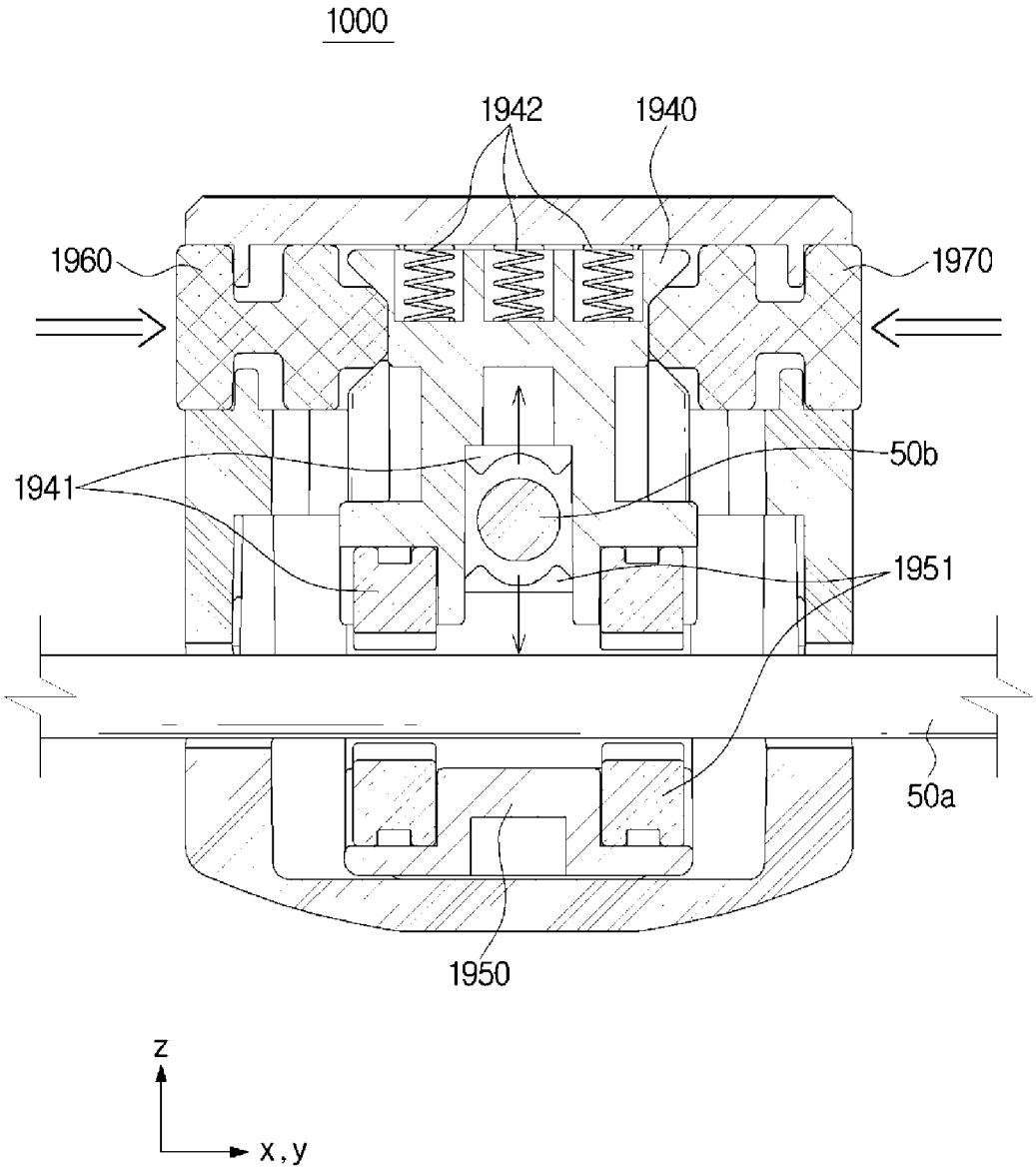

FIGS. 25A and 25B are cross-sectional views illustrating a process in which the partition member is changed from a fixed state to a non-fixed state in the moving guide 100 according to various embodiments.

It is assumed that all the components forming the moving guide 100 are coupled to each other.

Referring to FIG. 25A, the first stopper 1941 of the first partition fixing portion 1940 and the second stopper 1951 of the second partition fixing portion 1950 may be in contact with the partition member 50*a* and 50*b*. The first partition fixing portion 1940 and the second partition fixing portion 1950 may continuously receive the force in the direction in which the partition member 50*a* and 50*b* are placed, by the spring 1942 and 1952 of FIG. 23.

Referring to FIG. 25B, the lever 1960 and 1970 may be moved in a third direction by a user. The third direction may represent a direction inward of the moving guide 1000. According to the movement of the lever 1960 and 1970, the first inclined surface 1961 and 1971 may push the inclined surface 1945 of the first partition fixing portion 1940 so as to move the first partition fixing portion 1940 to a fourth direction. The fourth direction may represent the upper direction (+Z axis). According to the movement of the lever 1960 and 1970, the second inclined surface 1962 and 1972 may push the inclined surface 1955 of the second partition fixing portion 1950 so as to move the second partition fixing portion 1950 to a fifth direction. The fifth direction may represent the lower direction (−Z axis).

In this time, the stopper 1941 of the first partition fixing portion 1940 and the stopper 1951 of the second partition fixing portion 1950 may be disengaged from the partition member 50. Therefore, a user may easily adjust the size of the space generated by the partition member 50 by using the moving guide 1000.

In other words, the first partition member 50*a* and the second partition member 50*b* may configured to move independently from each other or move together at the same time.

As is apparent from the above description, according to the proposed storage container having a storage space, since the storage container is provided with a partition member configured to divide the storage space of the storage container by having a first partition movable in a first direction in the storage space, and a second partition movable in a second direction in the storage space while crossing the first partition; and a moving guide provided in the intersection between the first partition and the second partition and configured to guide the movement of the first partition and the second partition and to fix the first partition and the second partition so as not to move and since it is possible to move a partition fixing portion in the moving guide to a direction in contact with the partition member according to the rotation of the upper portion, it is possible to set and fix an inner space, which is desired by a user.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A storage container having a storage space comprising:

a partition member configured to divide the storage space of the storage container, the partition member having a first partition member movable in a first direction in the storage space, and a second partition member movable in a second direction in the storage space so that the first partition member and the second partition member cross each other;

a moving guide provided in an intersection between the first partition member and the second partition member and configured to guide a movement of the first partition member and a movement of the second partition member, the moving guide including:

an upper portion;

a middle portion rotatably coupled to the upper portion;

a lower portion coupled to the middle portion, the coupled middle portion and lower portion forming an accommodation space therein; and a partition fixing portion provided in the accommodation space and movable along a central axis of the upper portion, middle portion, and lower portion within the accommodation space relative to the upper portion, middle portion, and lower portion when the upper portion is rotated with respect to the middle portion, wherein when the upper portion of the moving guide is rotated in one direction, the partition fixing portion is moved along the central axis relative to the upper portion, middle portion, and lower portion to an unlocked position within the accommodation space so that the moving guide guides at least one of the movement of the first partition member in the first direction and the movement of the second partition member in the second direction, wherein when the upper portion is rotated in an opposite direction to the one direction, the partition fixing portion is moved along the central axis relative to the upper portion, middle portion, and lower portion to a locked position within the accommodation space so that the moving guide secures the first partition member and the second partition member between the partition fixing portion and the lower portion, and wherein the upper portion of the moving guide is provided with an inclined surface inside thereof, and the partition fixing portion comprises a follower in contact with the inclined surface, and wherein when the upper portion is rotated, the partition fixing portion is moved based on a difference in the height of the inclined surface.

2. The storage container of claim 1, wherein the moving guide includes a first through hole through which the first partition member is passed and a second through hole vertically spaced apart from the first through hole and through which the second partition member is passed.

3. The storage container of claim 2, wherein the moving guide forms the first through hole and the second through hole by the coupling between the middle portion and the lower portion.

4. The storage container of claim 1, wherein the partition fixing portion further comprises a stopper, wherein the stopper is in contact with the first partition member and the second partition member to secure the movement of the first partition member and the second partition member in the locked position.

5. The storage container of claim 4, wherein a surface of the stopper is formed of a material having high frictional force.

6. The storage container of claim 4, wherein the stopper is formed of a silicon or a rubber material.

7. The storage container of claim 4, wherein when the partition fixing portion is furthest away from the upper portion according to a rotation of the upper portion, the stopper comes into contact with the first partition member and the second partition member.

8. The storage container of claim 1, wherein the inclined surface of the upper portion further comprises a locking protrusion, wherein when the locking protrusion comes into contact with the follower, which moves with the contact with the inclined surface, and then the contact between the locking protrusion and the follower is released according to a rotation of the upper portion, a vibration or the noise is generated by the contact between the inclined surface and the follower.

9. The storage container of claim 4, wherein when the upper portion is rotated in the opposite direction, the stopper comes into contact with the first partition member and the second partition member and when the upper portion is rotated in the one direction, the stopper is away from the first partition member and the second partition member.

10. The storage container of claim 1, wherein the first partition member and the second partition member are configured to move independently from each other or move together.

11. A refrigerator comprising:

a body having a storage compartment;

a door configured to open or close the storage compartment;

a storage container configured to be inserted into or pulled out from the storage compartment and having a storage space;

a partition member configured to divide the storage space of the storage container, the partition member having a first partition member movable in a first direction in the storage space, and a second partition member movable in a second direction in the storage space so that the first partition member and the second partition member cross each other;

a moving guide provided in an intersection between the first partition member and the second partition member and configured to guide a movement of the first partition member and a movement of the second partition member, the moving guide including:

an upper portion;

a middle portion rotatably coupled to the upper portion; and a lower portion coupled to the middle portion, the coupled middle portion and lower portion forming an accommodation space therein; and a partition fixing portion provided in the accommodation space and movable along a central axis of the upper portion, middle portion, and lower portion within the accommodation space relative to the upper portion, middle portion, and lower portion when the upper portion is rotated with respect to the middle portion, wherein when the upper portion of the moving guide is rotated in one direction, the partition fixing portion is moved along the central axis relative to the upper portion, middle portion, and lower portion to an unlocked position within the accommodation space so that the moving guide guides at least one of the movement of the first partition member in the first direction and the movement of the second partition member in the second direction, wherein when the upper portion is rotated in an opposite direction to the one direction, the partition fixing portion is moved along the central axis relative to the upper portion, middle portion, and lower portion to a locked position within the accommodation space so that the moving guide secures the first partition member and the second partition member between the partition fixing portion and the lower portion, and wherein the upper portion of the moving guide is provided with an inclined surface inside thereof, and the partition fixing portion comprises a follower in contact with the inclined surface, and wherein when the upper portion is rotated, the partition fixing portion is moved based on a difference in the height of the inclined surface.

12. A moving guide to manipulate spacing of a storage of a refrigerator comprising:

an upper portion;

a middle portion rotatably coupled to the upper portion; and a lower portion coupled to the middle portion, the coupled middle portion and lower portion forming an accommodation space therein; and a partition fixing portion provided in the accommodation space and movable along a central axis of the upper portion, middle portion, and lower portion within the accommodation space relative to the upper portion, middle portion, and lower portion when the upper portion is rotated with respect to the middle portion, wherein when the upper portion is rotated in one direction, the partition fixing portion is moved along the central axis relative to the upper portion, middle portion, and lower portion to an unlocked position within the accommodation space so that the moving guide guides at least one of a movement of a first partition member and a movement of a second partition member to manipulate spacing in the storage of the refrigerator, wherein when the upper portion is rotated in an opposite direction to the one direction, the partition fixing portion is moved along the central axis relative to the upper portion, middle portion, and lower portion to a locked position within the accommodation space so that the moving guide secures the first partition member and the second partition member between the partition fixing portion and the lower portion, and wherein the upper portion of the moving guide is provided with an inclined surface inside thereof, and the partition fixing portion comprises a follower in contact with the inclined surface, and wherein when the upper portion is rotated, the partition fixing portion is moved based on a difference in the height of the inclined surface.

* * * * *